US008418497B2

(12) United States Patent
Lee et al.

(10) Patent No.: US 8,418,497 B2
(45) Date of Patent: Apr. 16, 2013

(54) REFRIGERATOR

(75) Inventors: Bok Dong Lee, Changwon (KR); Seung-Mok Lee, Changwon (KR); Kap Rok Han, Changwon (KR); Chang Woan Yang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 575 days.

(21) Appl. No.: 12/650,531

(22) Filed: Dec. 30, 2009

(65) Prior Publication Data

US 2010/0101260 A1 Apr. 29, 2010

Related U.S. Application Data

(63) Continuation of application No. 11/815,192, filed as application No. PCT/KR2006/000357 on Feb. 1, 2006, now abandoned.

(30) Foreign Application Priority Data

| | | |
|---|---|---|
| Feb. 1, 2005 | (KR) | 10-2005-0008905 |
| Feb. 2, 2005 | (KR) | 10-2005-0009362 |
| Feb. 17, 2005 | (KR) | 10-2005-0012991 |
| Feb. 25, 2005 | (KR) | 10-2005-0015692 |
| Feb. 25, 2005 | (KR) | 10-2005-0015693 |
| Mar. 2, 2005 | (KR) | 10-2005-0017123 |
| Mar. 2, 2005 | (KR) | 10-2005-0017125 |
| Mar. 8, 2005 | (KR) | 10-2005-0019051 |
| Mar. 23, 2005 | (KR) | 10-2005-0014749 |

(51) Int. Cl.
*F25D 3/02* (2006.01)

(52) U.S. Cl.
USPC ..... 62/420

(58) Field of Classification Search ..... 62/420, 62/407, 441, 449
See application file for complete search history.

(56) References Cited

U.S. PATENT DOCUMENTS

| | | | | |
|---|---|---|---|---|
| 2,943,452 | A * | 7/1960 | Buchanan | 62/3.3 |
| 3,146,606 | A | 9/1964 | Grimes et al. | |
| 3,561,231 | A | 2/1971 | Webb | |
| 5,211,462 | A | 5/1993 | Bien et al. | |
| 5,706,673 | A * | 1/1998 | Shin | 62/455 |
| 6,401,461 | B1 * | 6/2002 | Harrison et al. | 62/3.61 |
| 6,735,959 | B1 | 5/2004 | Najewicz | |
| 6,945,068 | B2 | 9/2005 | Kim et al. | |

(Continued)

FOREIGN PATENT DOCUMENTS

| | | | |
|---|---|---|---|
| EP | 1598618 | A1 | 11/2005 |
| EP | 1684036 | A2 | 7/2006 |
| JP | 2001-221555 | A | 8/2001 |
| KR | 10-2004-0102571 | A | 12/2004 |

*Primary Examiner* — Melvin Jones
(74) *Attorney, Agent, or Firm* — Birch, Stewart, Kolasch & Birch, LLP

(57) ABSTRACT

A refrigerator is disclosed which enables the user to easily take ice out of an ice maker without causing a variation in the capacity of the refrigerator or a limitation on the position of a freezing compartment. The refrigerator includes a refrigerator body which includes a freezing compartment and a refrigerating compartment, an ice making compartment which is arranged in the refrigerating compartment, to make ice, a heat exchanger which generates cold air for freezing food storing stored in the freezing compartment, and a cold air guiding device which guides the cold air generated by the heat exchanger to the ice making compartment, to enable the ice making compartment to make ice.

11 Claims, 21 Drawing Sheets

U.S. PATENT DOCUMENTS 6,978,626 B2 12/2005 Kim et al.
7,185,507 B2 3/2007 Maglinger et al.
2004/0108799 A1 6/2004 Leimkuehler et al.
2005/0252232 A1 11/2005 Lee et al.

* cited by examiner

REFRIGERATOR

This application is a Continuation of application Ser. No. 11/815,192, filed on May 19, 2008, now abandoned and for which priority is claimed under 35 U.S.C. §120. Application Ser. No. 11/815,192 is a National Stage Entry of PCT International Application No. PCT/KR2006/000357, filed on Feb. 1, 2006, which designates the United States, and for which priority is claimed under 35 U.S.C. §120. This application also claims priority under 35 U.S.C. §119(a) on Patent Application No. 10-2005-0008905, filed in the Republic of Korea on Feb. 1, 2005, Patent Application No. 10-2005-0009362, filed in Korea on Feb. 2, 2005, Patent Application No. 10-2005-0012991, filed in the Republic of Korea on Feb. 17, 2005, Patent Application No. 10-2005-0014749, filed in the Republic of Korea on Feb. 23, 2005, Patent Application No. 10-2005-0015693, filed in the Republic of Korea on Feb. 25, 2005, Patent Application No. 10-2005-0015692, filed in the Republic of Korea on Feb. 25, 2005, Patent Application No. 10-2005-0017125, filed in the Republic of Korea on Mar. 2, 2005, Patent Application No. 10-2005-0017123, filed in the Republic of Korea on Mar. 2, 2005 and Patent Application No. 10-2005-0019051, filed in the Republic of Korea on Mar. 8, 2005. The entire contents of each of the above documents are hereby incorporated by reference.

TECHNICAL FIELD

The present invention relates to a refrigerator, and more particularly, to a refrigerator which includes an ice making compartment for making ice.

BACKGROUND ART

Generally, refrigerators are used to store food in a low-temperature and fresh state for a prolonged period of time. Such a refrigerator stores in a frozen or refrigerated state in accordance with the state or kind of the food.

In order to store food in a low-temperature state, the refrigerator includes a refrigerant system which repeatedly performs a refrigerant cycle of compression-condensation-expansion-evaporation.

Hereinafter, a conventional refrigerator will be described with reference to FIG. 1.

Referring to FIG. 1, the conventional refrigerator includes a refrigerator body 10 which includes a refrigerating compartment 20 for storing food in a refrigerated state, and a freezing compartment 30 for storing food in a frozen state.

The refrigerating compartment 20 and freezing compartment 30 are partitioned such that they have independent spaces, respectively. Each of the refrigerating compartment 20 and freezing compartment 30 is provided with an opening at the front side thereof.

The opening of the refrigerating compartment 20 is opened or closed by refrigerating compartment doors 22. The opening of the freezing compartment 30 is opened or closed by a freezing compartment door 32.

Generally, the refrigerating compartment 20 is more frequently used than the freezing compartment 30. To this end, the refrigerating compartment 20 is arranged over the freezing compartment 30 so as to enable the user to easily take out the food stored in the refrigerating compartment 20 without bending his body.

Drawers, baskets, and shelves for receiving food of various sizes and states are provided in the interior of the refrigerating compartment 20 and at the refrigerating compartment doors 22.

The freezing compartment door 32 is slidable in forward and rearward directions to open or close the freezing compartment 30. A lower door handle is attached to the front surface of the freezing compartment door 32 at the upper portion of the freezing compartment door 32, to enable the user to slide the freezing compartment door 32 while grasping the lower door handle.

An ice maker 40 is arranged in the freezing compartment 30, in order to make ice using cold air generated by a heat exchanger and supplied to the freezing compartment 30.

However, the conventional refrigerator having the above-mentioned configuration has various problems.

First, there is a problem in that the ice maker 40, which makes ice, is arranged in the interior of the freezing compartment 30, and the freezing compartment 30 is arranged beneath the refrigerating compartment 20 in the conventional refrigerator having the above-mentioned configuration. That is, it is inconvenient for the user to take ice out of the ice maker 40 because the user must operate the ice maker 40 after opening the freezing compartment door 32 while bending his body.

The above-mentioned problem may be solved by arranging the freezing compartment 30 over the refrigerating compartment 20. In this case, however, it is difficult for a short man or a child to take ice out of the ice maker 40 arranged in the interior of the freezing compartment 30, after opening the freezing compartment 30, in the case in which the refrigerator has a large size.

Meanwhile, the ice maker 40 may be installed at an appropriate position outside the freezing compartment 30, separately from the freezing compartment 30. In this case, however, there are various problems, for example, an increase in the manufacturing costs of the refrigerator, an increase in the volume of the refrigerator, and a difficulty in the manufacture of the refrigerator, because an ice-making heat exchanger must be installed in the ice making compartment.

For the above-mentioned reasons, it is required to develop a refrigerator which enables the user to easily take ice out of an ice maker without causing a variation in the capacity of the refrigerator or a limitation on the position of a freezing compartment.

DISCLOSURE OF INVENTION

Technical Problem

An object of the present invention devised to solve the above-mentioned problems lies in providing a refrigerator which enables the user to easily take ice out of an ice maker without causing a variation in the capacity of the refrigerator or a limitation on the position of a freezing compartment.

Technical Solution

In accordance with the present invention, this object can be accomplished by providing a refrigerator comprising: a refrigerator body which includes a freezing compartment and a refrigerating compartment; an ice making compartment which is arranged in the refrigerating compartment, to make ice; a heat exchanger which generates cold air for freezing food stored in the freezing compartment; and a cold air guiding device which guides the cold air generated by the heat exchanger to the ice making compartment, to enable the ice making compartment to make ice.

Preferably, the ice making compartment is arranged inside a refrigerating compartment door unit which opens or closes an inner space of the refrigerating compartment. Preferably, the refrigerating compartment is arranged over the freezing compartment.

Preferably, the cold air guiding device includes a duct unit which communicates with the ice making compartment.

The refrigerator may further comprise a cold air supply fan which forcibly supplies the cold air generated by the heat exchanger to the ice making compartment.

The duct unit may include an air supply duct which supplies the cold air generated by the heat exchanger to the ice making compartment, and a return duct which guides the cold air from the ice making compartment to the freezing compartment.

In other words, the duct unit may include at least one duct which is provided at one side wall of the refrigerating compartment such that the duct communicates with the ice making compartment.

Preferably, the duct is arranged between an outer wall and an inner wall which bin the side wall of the refrigerating compartment.

More preferably, the duct may be spaced apart from the outer wall and the inner wall.

To this end, the refrigerator further comprises a spacer which supports the duct such that the duct is spaced apart from the outer wall and the inner wall.

The spacer may include two spacing ribs which are protruded from an outer surface of the duct, to space the duct from the outer wall and inner wall by the same distance, respectively. Preferably, the spacing ribs are symmetrical to each other.

The refrigerator may further comprise a duct holder which fixes the duct to the side wall of the refrigerating compartment.

The duct may be internally installed between the outer wall and the inner wall under a condition in which the duct is held by the duct holder.

The duct holder may include at least one duct receiver which firmly receives the duct, and spacing protrusions which are outwardly protruded from the duct receiver, to space the duct from the outer wall and the inner wall.

The at least one duct may comprise a pair of ducts, and the at least one duct receiver may comprise a pair of duct receivers which are connected to each other such that the duct receivers are integral, the duct receivers receiving the ducts, respectively.

Preferably, the refrigerator further comprises a first heater which prevents a frosting phenomenon from occurring in the refrigerating compartment due to the cold air flowing through the duct.

In this case, the duct is installed in the side wall of the refrigerating compartment, and the first heater is arranged on an inner surface of the side wall.

Preferably, the inner wall of the refrigerating compartment has a first opening which forms one end of the duct unit, and the first heater is arranged adjacent to the first opening.

The refrigerator may further comprise a cold air guide which is arranged in a barrier partitioning the refrigerating compartment and the freezing compartment, to connect the duct unit to the freezing compartment.

The barrier may include a cover which is separably coupled to the cold air guide.

The cold air guide may include an air supply passage which guides the cold air generated by the heat exchanger to the duct unit, and a return passage which guides the cold air guided through the duct unit after emerging from the ice making compartment to the freezing compartment.

The refrigerator may further comprise a second heater which is provided at one surface of the barrier facing an inner space of the refrigerating compartment, to prevent a frosting phenomenon from occurring in the refrigerating compartment due to the cold air guide. The second heater may operate selectively in accordance with a predetermined condition.

In this case, the ice making compartment is provided at a refrigerating compartment door unit which opens or closes an inner space of the refrigerator. The duct unit includes a first opening which is provided at an inner wall of the refrigerating compartment, and forms one end of the duct unit connected to one side of the refrigerating compartment door unit. The refrigerating compartment door unit includes a second opening which is connected to the first opening, to connect the duct unit to an inner space of the ice making compartment.

The refrigerator may further comprise a sealing unit which is provided at least one of the first and second openings, to prevent air from being leaked between the first and second openings.

The sealing unit may include a gasket, and a gasket fixer which fixes the gasket to at least one of the first and second openings.

The gasket fixer may include a gasket supporter which is coupled to at least one of the first and second openings, and a gasket holder which fixes the gasket to the gasket supporter.

The ice making compartment may include a door duct unit which is provided at a refrigerating door unit for opening or closing an inner space of the refrigerating compartment, to connect the duct unit to an inner space of the freezing compartment.

The ice making compartment may includes an ice making chamber which receives an ice maker for making ice using the cold air generated by the heat exchanger, and an ice making compartment door which opens or closes an opening formed at a rear side of the ice making chamber.

The ice making compartment door may be hingably movable by a hinge mounted to one side of the ice making chamber. The ice making compartment door may include a hinge cover which covers the hinge.

Advantageous Effects

The refrigerator according to the present invention has various effects as follows.

First, since the refrigerator according to the present invention includes the cold air guiding device for guiding the cold air generated by the heat exchanger, which controls the temperature of the freezing compartment, to the ice making compartment, it is possible to appropriately select the position of the ice making compartment irrespective of the structure or capacity of the refrigerator. Accordingly, it is possible to achieve an improvement in the freedom of design of the refrigerator, and a reduction in the manufacturing costs of the refrigerator, and to maximize the inner space of the refrigerating compartment.

Second, in the refrigerator according to the present invention, it is possible to conveniently use the refrigerating compartment, and to easily take ice out of the ice making compartment because the freezing compartment is arranged beneath the refrigerating compartment.

Third, in the refrigerator according to the present invention, it is possible to prevent a frosting phenomenon from occurring in the refrigerating compartment due to the cold air guiding device, which guides cold air, because the heater is arranged on the inner surface of the refrigerating compartment.

Fourth, in the refrigerator according to the present invention, it is possible to easily fill a foaming liquid because the duct is arranged at a correct position between the outer wall and inner wall, which form one side wall of the refrigerating compartment, by spacing ribs and/or spacing protrusions.

Fifth, since the refrigerator according to the present invention includes the duct holder for fixing the duct to one side wall of the refrigerating compartment, it is possible to easily install the duct.

Sixth, since the refrigerator according to the present invention includes the hinge cover, which covers the hinge for hingably opening or closing the ice making compartment door, it is possible to prevent an accident in that a portion of the body of the user is caught in the hinge through his carelessness, and to make the appearance of the ice making compartment beautiful.

BRIEF DESCRIPTION OF THE DRAWINGS

The accompanying drawings, which are included to provide a further understanding of the invention, illustrate embodiments or the invention and together with the description serve to explain the principle of the invention.

In the drawings.

BEST MODE FOR CARRYING OUT THE INVENTION

Figure 1:
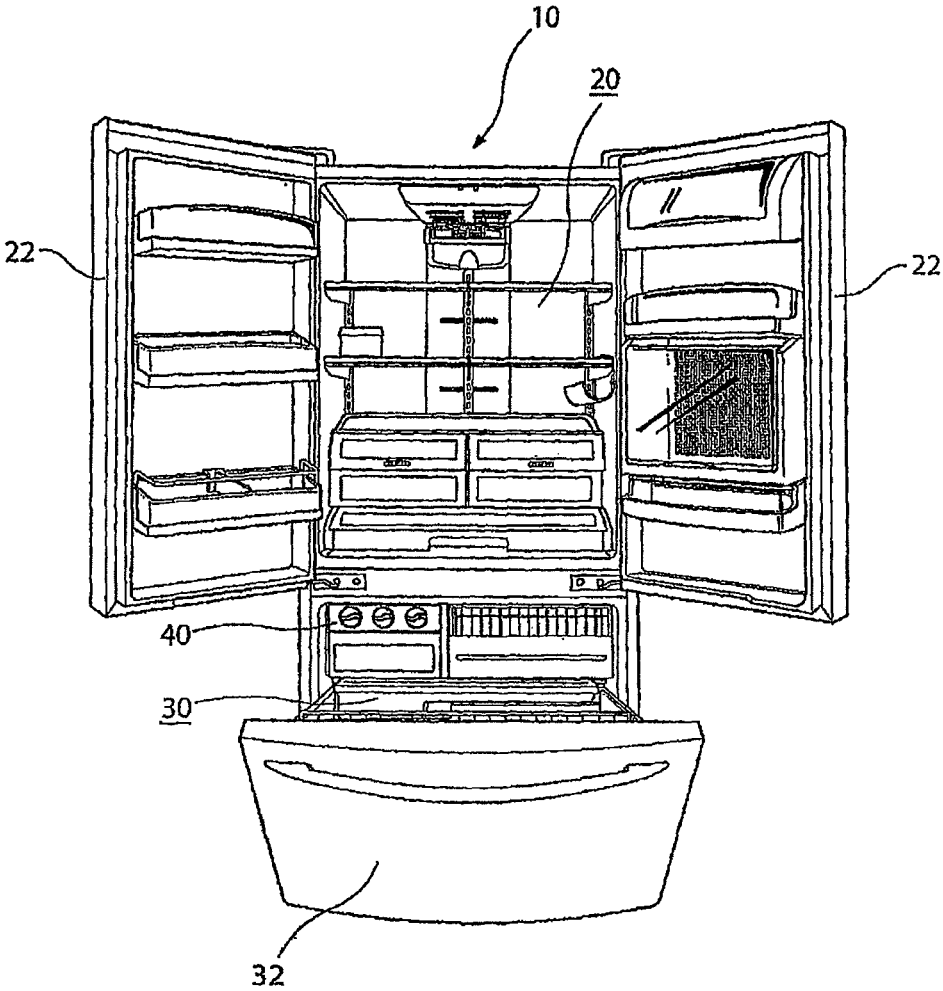
FIG. 1 is a perspective view of a conventional refrigerator, illustrating an opened state of refrigerating compartment doors and an opened state of a freezing compartment door.

Reference will now be made in detail to the preferred embodiments of the present invention, examples of which are illustrated in the accompanying drawings. In the following description, the same title and same reference numeral will be given for the same configuration, and no additional description will be given thereof.

Figure 2:
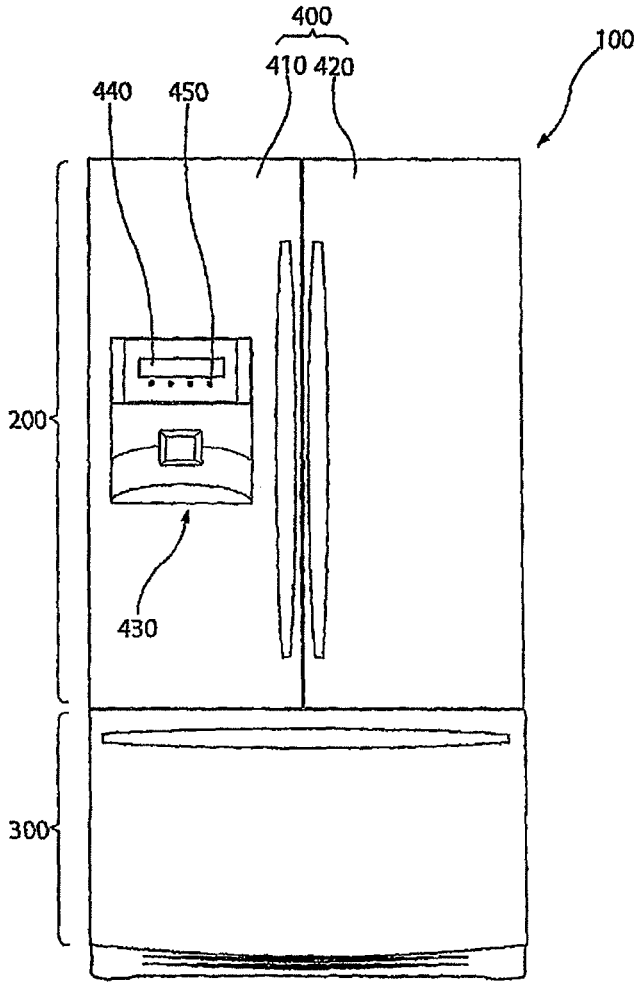
FIG. 2 is a front view illustrating a refrigerator according to a first embodiment of the present invention.
Figure 3:
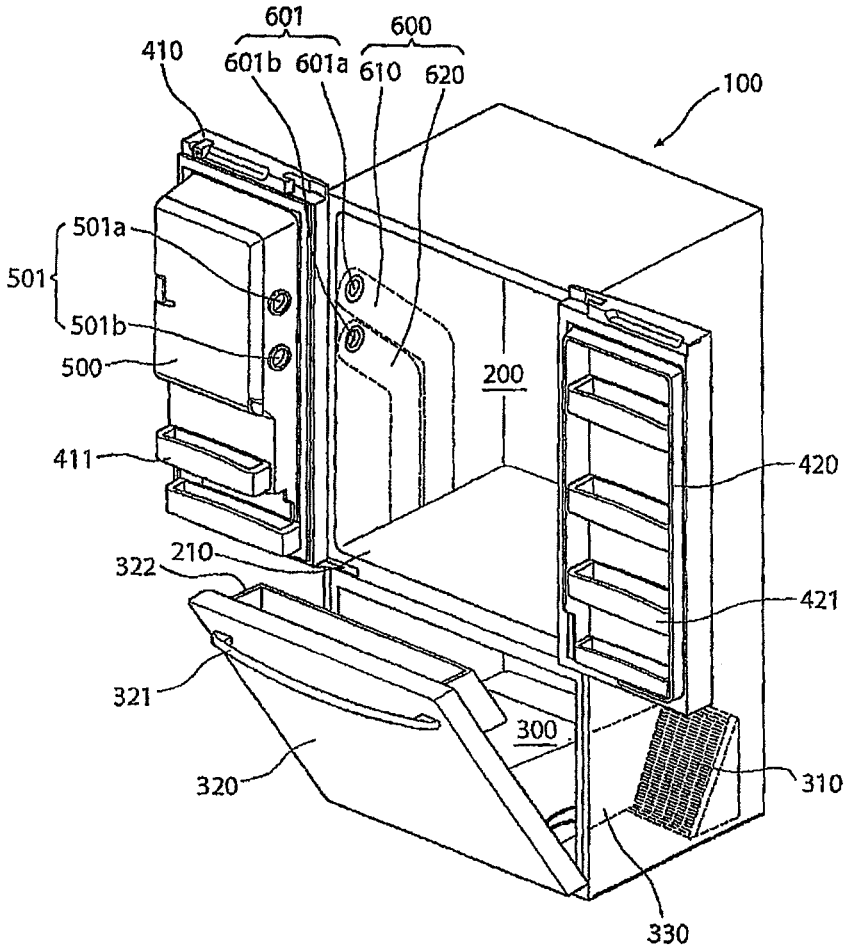
FIG. 3 is a perspective view illustrating an opened state of refrigerating compartment doors and an opened state of a freezing compartment door in the refrigerator shown in FIG. 2.
Figure 4:
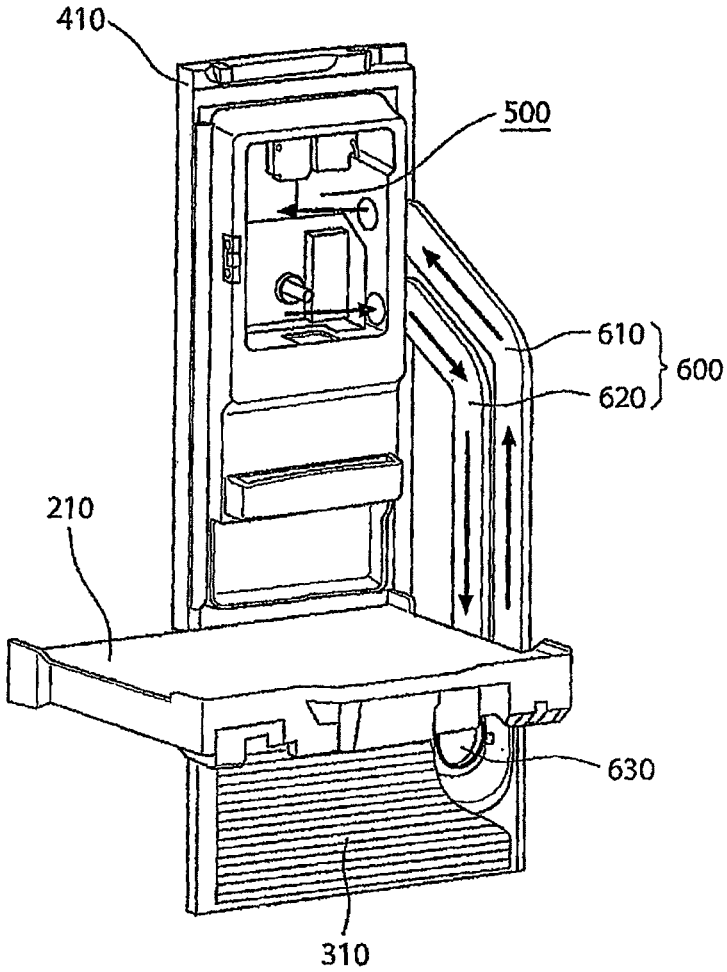
FIG. 4 is a perspective view illustrating flow paths of cold air in an ice making compartment and a cold air guide device in the refrigerator shown in FIG. 2.
Figure 5:
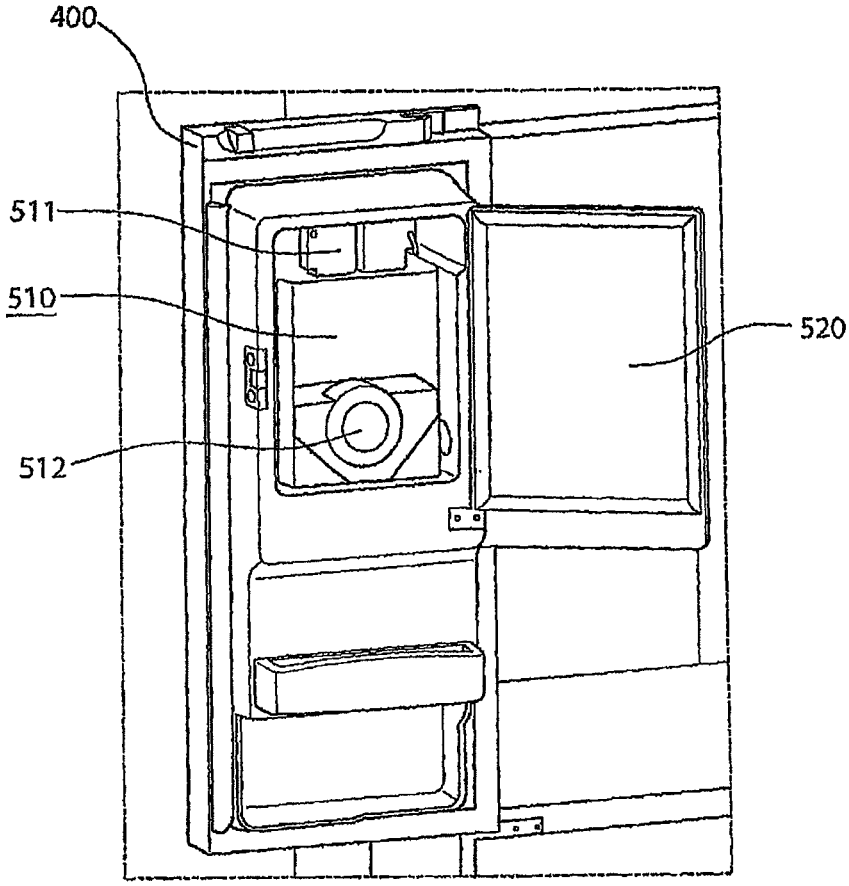
FIG. 5 is a perspective view illustrating the inner side of a part of one refrigerating compartment door where the ice making compartment is arranged, in the refrigerator shown in FIG. 2.

FIG. 2 is a front view illustrating a refrigerator according to a first embodiment of the present invention. FIG. 3 is a perspective view illustrating an opened state of refrigerating compartment doors and an opened state of a freezing compartment door in the refrigerator shown in FIG. 2. FIG. 4 is a perspective view illustrating flow paths of cold air in an ice making compartment and a cold air guide device in the refrigerator shown in FIG. 2. FIG. 5 is a perspective view illustrating the inner side of a part of one refrigerating compartment door where the ice making compartment is arranged, in the refrigerator shown in FIG. 2.

Referring to FIGS. 2 to 5, the refrigerator according to the first embodiment of the present invention includes a refrigerator body 100, and an ice making compartment 500 in which ice is made.

The inner space of the refrigerator body 100 is partitioned into a refrigerating compartment 200 and a freezing compartment 300.

Although not shown, shelves and drawers of various shapes are arranged in the refrigerating compartment 200, in order to efficiently receive various kinds of food.

The flow of cold air supplied to the refrigerating compartment 200 at one side of the refrigerating compartment 200 is influenced by the shelves and drawers such that convection of the cold air is limited or controlled. As a result, the cold air is supplied in different amounts to portions of the refrigerating compartment 200 defined by the shelves and drawers, respectively, so that the portions of the refrigerating compartment 200 have different temperature characteristics. Thus, it is possible to store food in an appropriate portion of the refrigerating compartment 200, depending on the storage condition of the food.

Meanwhile, the refrigerating compartment 200 is open at the front side thereof. The refrigerating compartment 200 includes a refrigerating compartment door unit 400 which selectively opens or closes the front side of the refrigerating compartment 200. Thus, the refrigerating compartment door unit 400 opens or closes the inner space of the refrigerating compartment 200.

The refrigerating compartment door unit 400 includes a pair of hinged doors 410 and 420 hingably connected to the refrigerator body 100.

The left one of the hinged doors 410 and 420, namely, the door 410, may be hingably connected, at the left end thereof, to the left corners of the front side of the refrigerating compartment 200 by means of hinges, respectively. The right one of the hinged doors 410 and 420, namely, the door 420, may be hingably connected, at the right end thereof, to the right corners of the front side of the refrigerating compartment 200 by means of hinges, respectively. Thus, the left and right doors 410 and 420 are openable independently of each other.

Shelves 411 and 421 may be installed at the refrigerating compartment door unit 400, in order to receive drink bottles and other food.

The freezing compartment 300 is adapted to store fish, meat, or food required to be stored for a prolonged period of time, in a frozen state. Drawers and baskets (not shown) are arranged in the freezing compartment 300, in order to separately store a variety of food to be stored in a frozen state, depending on the size or state of the food.

The temperature of the freezing compartment 300 is controlled by a heat exchanger 310 installed at the refrigerator body 100. In detail, the inner space of the freezing compartment 300 is maintained in a low-temperature state by cold air generated by the heat exchanger 310, in order to freeze the food stored in the freezing compartment 300.

In other words, a refrigerant, which passes through the heat exchanger 310, is evaporated as it absorbs heat from cold air supplied to the freezing compartment 300, thereby lowering the temperature of the cold air. Thus, the inner space of the freezing compartment 300 is maintained at a temperature capable of storing food in a frozen state.

The heat exchanger 310 is arranged at the rear side of the freezing compartment 300, in particular, at the rear side of a storage box 330 arranged in the freezing compartment 300. Here, the storage box 330 receives the above-described drawers and/or baskets, in order to store food.

Preferably, a fan (not shown) is arranged at one side of the heat exchanger 310, in order to forcibly circulate air in the freezing compartment 300.

A freezing compartment door 320 is arranged at the open front side of the freezing compartment 300, in order to open or close the freezing compartment 300. The freezing compartment door 320 is hingably connected, at a lower end thereof, to a lower end of the front side of the storage box 330. The storage box 330 is coupled to the refrigerator body 100 such that the storage box 330 is slidable in forward and rearward directions. The storage box 330 is forwardly extendable or rearwardly retractable together with the freezing compartment door 320.

A lower handle 321 may be attached to a front surface of the freezing compartment door 320, in order to open or close the freezing compartment door 320. A shelf 322, which can receive food, may be attached to a rear surface of the freezing compartment door 320.

Meanwhile, in this embodiment, the heat exchanger 310 is configured to perform temperature control for both the refrigerating compartment 200 and the freezing compartment 300. Of course, the refrigerating compartment 200 may be temperature-controlled by a separate heat exchanger (not shown).

The refrigerating compartment 200 and freezing compartment 300, which have the above-described configurations, respectively, are partitioned by a bather 210.

Generally, the refrigerating compartment 200 is more frequently used than the freezing compartment 300. To this end, it is preferred that the refrigerating compartment 200 be arranged over the freezing compartment 300 so as to enable the user to easily take out the food stored in the refrigerating compartment 200 without bending his body.

Accordingly, the barrier 210 is horizontally arranged in the refrigerator body 100 such that the barrier 210 defines the bottom of the refrigerating compartment 200, and the top of the freezing compartment 300.

Meanwhile, the ice making compartment 500 basically functions to make ice, and to store the ice. It is preferred that the ice making compartment 500 be arranged at an appropriate position in the refrigerator, in order to enable the user to easily take out ice made in the ice making compartment 500, irrespective of the size or capacity of the refrigerator, and the arrangement of the freezing compartment 300 and refrigerating compartment 200.

In conventional cases in which there is a limitation on the arrangement of an ice making compartment because the ice making compartment must be arranged in the freezing compartment, there is a difficulty in arranging the ice making compartment at an appropriate position in a refrigerator.

Therefore, in order to not only make ice using the above-described heat exchanger without use of a separate ice-making heat exchanger, but also to enable the ice maker to be arranged at an appropriate position enabling the user to most easily take out ice made by the ice maker, it is preferred that the refrigerator include a cold air guide device for guiding cold air generated by the heat exchanger 310 to the ice making compartment 500.

In other words, there is a feature of the present invention in that the refrigerator includes a cold air guide device for guiding a part of cold air generated by the heat exchanger 310, in order to enable the ice maker to be arranged at a most appropriate position, irrespective of the size or capacity of the refrigerator, and the arrangement of the freezing compartment 300 and refrigerating compartment 200.

This feature of the present invention is more effective when the freezing compartment 300 is arranged beneath the refrigerating compartment 200.

In other words, when the refrigerating compartment 200 is arranged over the freezing compartment 300, it is possible to more easily take out the food stored in the inner space of the refrigerating compartment 200, in particular, a lower portion of the refrigerating compartment 200.

Also, it is preferred that the ice making compartment 500 be arranged in the refrigerating compartment 200, in order to enable the user to easily take out the ice stored in the ice making compartment 500. In the illustrated case, the ice making compartment 500 is provided at the refrigerating compartment door unit 400.

Referring to FIGS. 2 to 5, a dispenser 430 is also provided at the refrigerating compartment door unit 400, in addition to the ice making compartment 500. The dispenser 430 fractions to enable the user to take out water purified in the refrigerator and ice made in the ice making compartment 500 at the outside of the refrigerator. Operating buttons 450 for control of the internal temperatures of the compartments in the refrigerator, and other functions, and a display unit 440 for displaying the operating state of the refrigerator are arranged on the front surface of the refrigerator body 100.

In accordance with this embodiment, the ice making compartment 500 is arranged at the inner side of the refrigerating door unit 400, in particular, at the inner side of the left door 410. The dispenser 430 is arranged to discharge the ice stored in the ice making compartment 500 at the front side of the left door 410. Of course, the ice making compartment 500 and dispenser 430 may be arranged at the right door 420.

In order to enable the dispenser 430 to discharge the ice made in the ice making compartment 500 by gravity, it is preferred that the ice making compartment 500 be arranged over the dispenser 430.

The ice making compartment 500 has a rear wall which is protruded from the left door 410 into the refrigerating chamber 200.

The ice making compartment 500 includes an ice making chamber 510 in which an ice maker 511 adapted to make ice using cold air generated by the heat exchanger 310 is received, and an ice making compartment door 520 which opens or closes an opening formed at a rear side of the ice making chamber 510.

The ice making compartment 500 is defined by an inner case (not shown) coupled to the rear surface of the left door 410. Accordingly, the inner space of the ice making compartment 500 is partitioned from the inner space of the refrigerating compartment 200.

The ice maker 511, which makes ice using cold air generated by the heat exchanger 310, is arranged in the interior of the ice making compartment 500, namely, the ice making chamber 510. A feeder 512 is also received in the ice making chamber 510. The feeder 512 is arranged beneath the ice maker 511, to store and feed ice made by the ice maker 511.

The feeder 512 not only stores ice made by the ice maker 511, but also feeds the ice to the dispenser 430, in order to enable the user to take out the ice through the dispenser 430, if necessary.

Meanwhile, the cold air guide device functions to guide the cold air generated by the heat exchanger 310 to the ice making chamber 510 of the ice making compartment 500.

Referring to FIGS. 3 and 4, the cold air guide device includes a duct unit 600 which communicates with the ice making compartment 500.

In detail, the duct unit 600 defines a flow path of the cold air generated by the heat exchanger 310. Preferably, the refrigerator according to the first embodiment of the present invention further includes a cold air supply fan 630 which forces the cold air generated by the heat exchanger 310 to flow through the ice making compartment 500.

Accordingly, a part of the cold air generated by the heat exchanger 310 is introduced into the ice making compartment 500 via the duct unit 600 in accordance with the driving of the cold air supply fun 630.

The ice making compartment 500 may be configured to be selectively connected to the duct unit 600, as in this embodiment.

In detail, the ice making compartment 500 and duct unit 600 are configured to be connected to each other only in a closed state of the left door 410.

In other words, when the left door 410 is closed, the ice making chamber 500 communicates with the duct unit 600.

For this configuration, a first opening 601 is formed through an inner wall of the refrigerating compartment 200. The first opening 601 defines one end of the duct unit 600, in particular, an upper end of the duct unit 600. A second opening 501, which is selectively connected to the first opening 601, is formed at the refrigerating door unit 400, in particular, the left door 410.

When the second opening 501 is connected to the first opening 610, the second opening 501 communicates with the inner space of the ice making compartment 500, in particular, the ice making chamber 510.

In detail, when the left door 410 is closed, the second opening 501 is connected to the first opening 601. On the other hand, when the left door 410 is opened, the second opening 501 is disconnected from the first opening 601.

Of course, although not shown, the ice making compartment 500 may be configured to always communicate with the duct unit 600. For this configuration, the duct unit 600 may be directly connected, at one end thereof, to one side of the refrigerator door unit 400 where the ice making compartment 500 is defined, and may be connected, at the other end thereof, to one side of the freezing compartment 300.

The duct unit 600 includes at least one duct, two ducts 610 and 620 in the illustrated case, arranged at one side wall of the refrigerating compartment 200.

Where the ice making compartment 500 is arranged at the left door 410, as in this embodiment, it is preferred that the ducts 610 and 620 be arranged at the left wall of the refrigerating compartment 200.

The ducts 610 and 620 function to supply cold air generated by the heat exchanger 310 to the ice making compartment 500. Hereinafter, these ducts are collectively referred to as an air supply duct 610.

In this embodiment, the air supply duct 610 is configured such that one end of the air supply duct 610, namely, the upper end of the air supply duct 610, communicates with the ice making compartment 500, and the other end of the air supply duct 610, namely, the lower end of the air supply duct 610, communicates with the freezing compartment 300. In accordance with this configuration, the air supply duct 610 guides a part of the cold air, supplied to the freezing compartment 300, to the ice making compartment 500.

Of course, the other end of the air supply duct 610 may be open to one side of the heat exchanger 310 such that the air supply duct 610 directly sucks cold air from the heat exchanger 310, to guide the sucked cold air to the ice making compartment 500.

Meanwhile, the cold air introduced into the ice making compartment 500 absorbs heat from water in the ice making compartment 500. The cold air emerging from the ice making compartment 500 may be introduced into the interior of the refrigerating compartment 200. However, it is preferred that the cold air emerging from the ice making compartment 500 be returned to the freezing compartment 300, taking into consideration the temperature difference between the cold air in the refrigerating compartment 200 and the cold air in the ice making compartment 500.

To this end, the duct unit 60 preferably further includes a duct 620 which is connected to the ice making compartment 500, to guide the cold air from the ice making compartment 500 to the freezing compartment 300. Hereinafter, the duct 620 is referred to as a return duct.

One end of the return duct 620, namely, the upper end of the return duct 620, is connected to the ice making compartment 500, whereas the other end of the return duct 620, namely, the lower end of the return duct 620, is connected to one side of the freezing compartment 300 such that the return duct 620 communicates with the inner space of the freezing compartment 300.

Meanwhile, the first opening 601 includes a duct-side air supply port 601*a* which allows the cold air emerging from the supply air duct 610 to be discharged into the ice making chamber 500. The second opening 501 includes a door-side inlet 501*a* which is formed through an inner wall of the left door 410 such that the door-side inlet 501*a* is selectively connected to the duct-side air supply port 601*a*.

Where the duct unit 600 further includes the return duct 620, as in this embodiment, the first opening 601 further includes a duct-side inlet 601*b* which receives the cold air emerging from the ice making compartment 500, to guide the received cold air to the freezing compartment 300. In this case, the second opening 501 further includes a door-side outlet 501*b* which is formed through the inner wall of the left door 410 such that the door-side outlet 501*b* is selectively connected to the duct-side inlet 601*b*.

Meanwhile, at least one of the ducts 610 and 620, in particular, at least one of the air supply duct 610 and return duct 620, is preferably arranged between outer and inner walls defining one side of the refrigerating compartment 200, namely, the left side of the refrigerating compartment 200.

Here, the outer wall defines the left appearance of the refrigerator body 100, whereas the inner wall defines the left inner wall of the refrigerating compartment 200.

In particular, it is preferred that the air supply duct 610 be arranged between the outer and inner walls, because the temperature of the cold air flowing through the air supply duct 610 is lower than the temperature of the cold air flowing through the return duct 620.

In order to minimize the influence of the duct unit 600 on the temperature of the refrigerating compartment 200, however, it is preferred that both the air supply duct 610 and the return duct 620 be arranged between the outer and inner walls, as in this embodiment.

The space between the walls of the refrigerating compartment 200, namely, the outer and inner walls of the refrigerating compartment 200 is filled with an insulating material such as foamed urethane, in order to prevent the internal temperature of the refrigerating compartment 200 from being varied by the cold air flowing through the duct unit 600, and to minimize an increase in the temperature of the cold air flowing through the ducts 610 and 620.

Where the air supply duct 610 is arranged at the left side of the refrigerating compartment 200 in the space between the outer and inner walls of the refrigerating compartment 200, it is preferred that the first opening 601 be arranged at the left inner wall of the refrigerating compartment 200. In this case, it is also preferred that the second opening 501 be arranged at the inner case of the refrigerating compartment door unit 400.

In detail, the duct-side air supply port 601*a* and duct-side inlet 601*b* may be formed at a front portion of the left inner wall of the refrigerating compartment 200.

One end of the air supply duct 610, namely, the outlet of the air supply duct 610, is connected to the duct-side air supply port 601*a*. One end of the return duct 620, namely, the inlet of the return duct 620, is connected to the duct-side inlet 601*b*.

Meanwhile, the door-side inlet 501*a* and door-side outlet 501*b* are formed at the inner case such that they correspond to the duct-side air supply port 601*a* and duct-side inlet 601*b*, respectively.

Of course, where one end of the air supply duct 610 is protruded from the inner wall of the refrigerating compartment 200, the outlet of the air supply duct 610 may form the duct-side air supply port. On the other hand, where one end of the return duct 620 is protruded from the inner wall of the refrigerating compartment 200, the inlet of the return duct 620 may form the duct-side air supply port.

In accordance with the above-described configuration, when the left door 410 is closed, the first opening 601 and second opening 501 are connected to each other. In this state, a part of the cold air supplied to the freezing compartment 300 is supplied to the interior of the ice making compartment 500 via the air supply duct 610. Also, the cold air used to make ice in the ice making compartment 500 is returned to the freezing compartment 300 via the return duct 620.

Hereinafter, operation of the refrigerator having the above-described configuration according to the first embodiment of the present invention will be described.

First, cold air, which is supplied to the freezing compartment 300 after being cooled by the heat exchanger 310, freezes food stored in the freezing compartment 300.

A part of the cold air, which is supplied to the freezing compartment 300 after being cooled by the heat exchanger 310, is guided to the ice making compartment 500 via the cold air guide device, in particular, the duct unit 600.

In detail, a part of cold air generated by the heat exchanger 310 is forcibly fed to the ice making compartment 500 via the air supply duct 610 by the cold air supply fan 630.

The cold air introduced into the ice making compartment 500 heat-exchanges with water supplied to the ice maker 540. Thus, making of ice is carried out in the ice making compartment 500.

The cold air, which has performed heat exchange, namely, has been used to make ice, is introduced into the return duct 620 through the duct-side inlet 601*b* connected to the door-side outlet 501*b*, and is then returned to the freezing compartment 300 via the return duct 620.

The cold air introduced into the freezing compartment 300 is cooled as it heat-exchanges again with the heat exchanger 310. The resultant cold air is then supplied to the freezing compartment 300 or ice making compartment 500.

Ice made in the ice making compartment 500 is stored in the feeder 512. The ice stored in the feeder 512 is subsequently externally discharged through the dispenser 420 in accordance with operation of the user.

MODE FOR THE INVENTION

Hereinafter, a refrigerator according to a second embodiment of the present invention will be described with reference to FIGS. 6 to 9.

Figure 6:
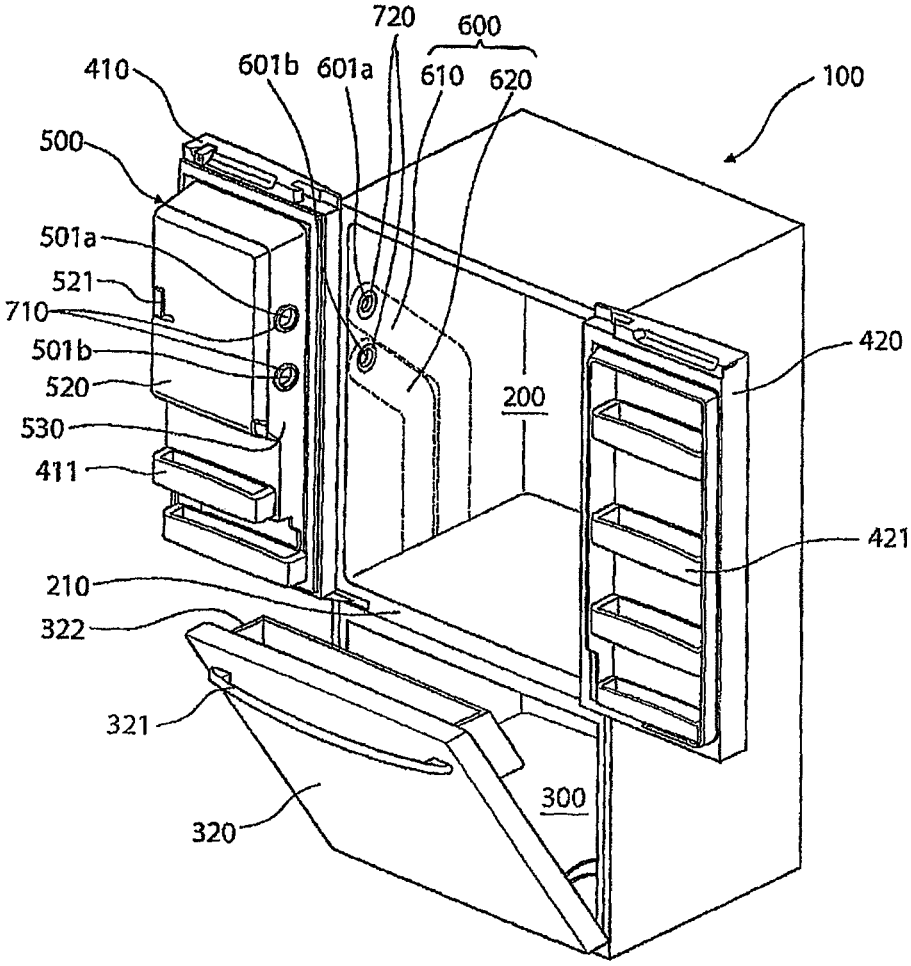
FIG. 6 is a perspective view of a refrigerator according to a second embodiment of the present invention, illustrating an opened state of refrigerating compartment doors and an opened state of a freezing compartment door.
Figure 7:
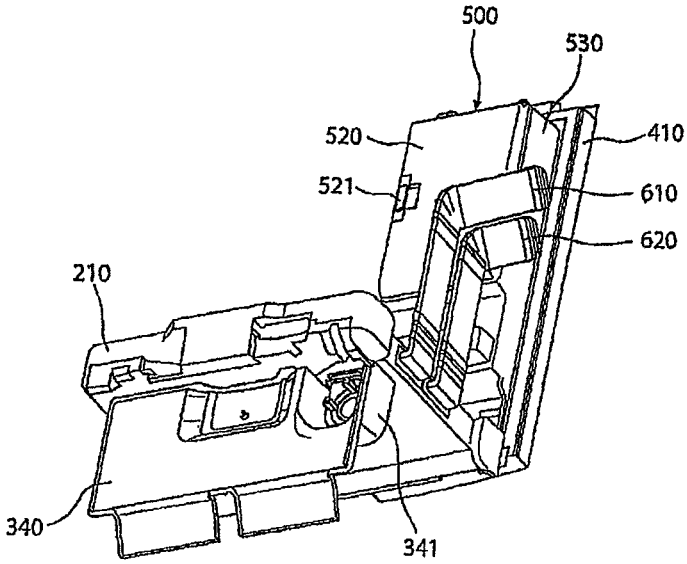
FIG. 7 is a perspective view illustrating a cold air guide device and one door of the refrigerator according to the second embodiment of the present invention.
Figure 8:
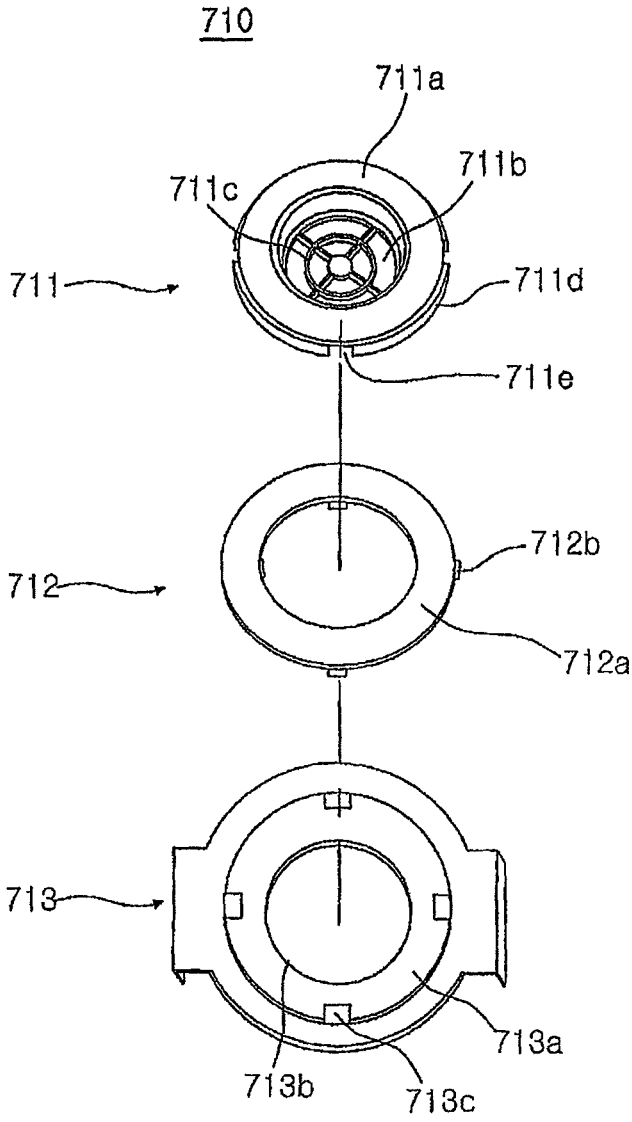
FIG. 8 is an exploded perspective view illustrating a sealing unit applied to the refrigerator shown in FIG. 7.
Figure 9:
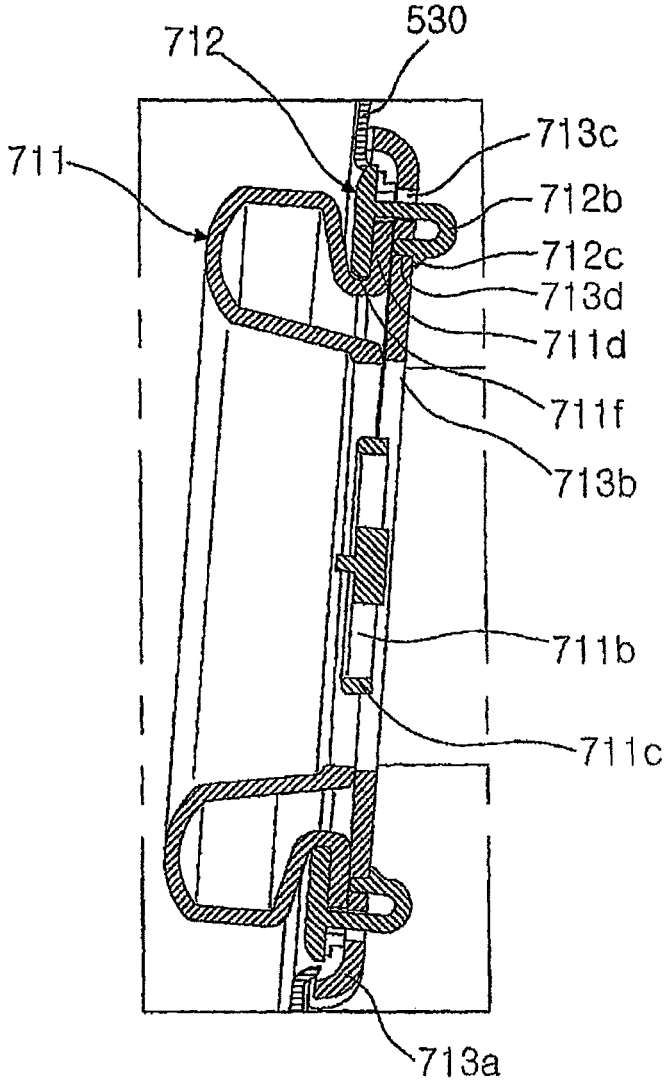
FIG. 9 is a sectional view illustrating the sealing unit applied to the refrigerator shown in FIG. 7.

FIG. 6 is a perspective view of the refrigerator according to the second embodiment of the present invention, illustrating an opened state of refrigerating compartment doors and an opened state of a freezing compartment door. FIG. 7 is a perspective view illustrating a cold air guide device and one door of the refrigerator according to the second embodiment of the present invention. FIG. 8 is an exploded perspective view illustrating a sealing unit applied to the refrigerator shown in FIG. 7. FIG. 9 is a sectional view illustrating the sealing unit applied to the refrigerator shown in FIG. 7.

The basic constituent elements of the refrigerator according to the second embodiment of the present invention are identical to those of the refrigerator according to the first embodiment of the present invention. In the following description given in conjunction with the refrigerator according to the second embodiment of the present invention, the constituent elements identical to those of the first embodiment of the present invention will be designated by the same reference numerals as those used in the first embodiment of the present invention, respectively, and no additional description thereof will be given.

The refrigerator according to the second embodiment of the present invention includes sealing units 710 and 720 for preventing cold air from being leaked between the first opening 601 and the second opening 501.

In order to enable the user to open or close the ice making compartment door 520 in the refrigerator according to the second embodiment of the present invention, a handle 521 is provided at the ice making compartment door 520. Also, the ice making compartment door 520 is hingably mounted to one edge of an opening formed through the rear wall of the ice making chamber 510.

The opening/closing structure of the ice making compartment door 520 and handle 521 may be applied to the refrigerator according to the first embodiment of the present invention in the same manner as described above.

The opening formed through the rear wall of the ice making chamber 510 is formed at an inner liner 530 which is coupled to the inner wall of the left door 410.

Accordingly, when the user pulls the handle 521 in an opened state of the left door 410, the ice making compartment door 520 is opened while being hingably moved.

The sealing units 710 and 720 may be provided at one of the first and second openings 601 and 501.

Of course, the sealing units 710 and 720 may be provided at the first and second openings 610 and 501, respectively.

Hereinafter, the sealing units 710 and 720 will be described in more detail with reference to FIGS. 8 and 9. Since the sealing units 710 and 720 have the same structure, the following description will be given only in conjunction with one of the sealing units 710 and 720, for example, the sealing unit 710.

The sealing unit 710 is provided at the second opening 510 of the inner case 530, and functions to prevent cold air from being leaked through the first opening 601 and the second opening 501.

The sealing unit 710 includes a gasket 711, and a gasket fixer for fixing the gasket 711 to the first opening 601 provided at the inner wall of the refrigerating compartment 200.

The gasket 711 is in contact with the first opening 601.

The gasket fixer includes a gasket supporter 713 which is coupled to the first opening 601, and a gasket holder 712 which fixes the gasket 711 to the gasket supporter 713.

In detail, the gasket holder 712 is coupled to the gasket supporter 713, to fix the gasket 711 to the gasket supporter 713. The gasket supporter 713 is coupled to the edge of the first opening 601, to fix the gasket 711 to the inner case 530.

The gasket 711 includes a gasket body 711*a*, and a holder coupler 711*d* for coupling the gasket 711 to the gasket holder 712.

A cold air hole 711*b* is provided at the gasket body 711*a* in order to allow the ice making compartment 500 and duct unit 600 to communicate with each other. The cold air hole 711*b* is formed through the gasket body 711*a*.

In this embodiment, the gasket body 711*a* is made up of a ring-shaped member such that the cold air hole 711*b* is defined at a central portion of the gasket body 711*a*.

It is preferred that a reinforcing rib 711*c* be provided at the cold air hole 711*b*. The reinforcing rib 711*c* includes a first rib having an approximately cross shape, and an annular second rib which has an outer diameter smaller than an inner diameter of the cold air hole 711*b*, and is formed integrally with the first rib.

The holder coupler 711*d* forms a holder receiving groove 711*f* for receiving the gasket holder 712. To form the holder receiving groove 7114 the holder coupler 711*d* extends radially inwardly from the edge of the gasket body 711*a*, and then extends radially outwardly after being bent.

Thus, the bent portion of the holder coupler 711*d* forms the holder receiving groove 711*f* for receiving the gasket holder 712, as shown in FIG. 9.

The gasket holder 712 includes a holder body 712*a* having an approximately ring shape, and at least one fixing member 712*b* which is coupled to the gasket supporter 713.

The holder body 712*a* is fitted in the holder receiving groove 711*f*. The fixing member 712*b* includes a hook extending from the edge of the holder body 712*a* at one side of the holder body 712*a* such that the hook is integral with the holder body 712*a*.

The hook extends toward the gasket supporter 713. The hook is coupled to the gasket supporter 713, thereby fixing the gasket 711 to the gasket supporter 713.

In detail, the portion of the holder coupler 711*d* extending from the bent portion of the holder coupler 711*d* outwardly from the gasket body 711*a* is interposed between the holder body 712*a* and the gasket supporter 713.

When the hook is engaged with the gasket supporter 713, the gasket 711 is partially supported by the gasket holder 712 and gasket supporter 713. Thus, the assembly of the sealing unit 710 is completed.

Meanwhile, a hook groove 711*e*, through which the hook extends, is fumed at the portion of the holder coupler 711*d* extending from the bent portion of the holder coupler 711*d* outwardly from the gasket body.

Here, the number of hook grooves 711*e* is identical to the number of hooks. In this embodiment, four hooks 711*e*, which are spaced apart from one another by an angle of 90°, are formed at the holder coupler 711*d*. Also, four hooks, which are spaced apart from one another by an angle of 90°, are formed at the holder body 712*a*.

The gasket supporter 713 includes a supporter body 713*a*, and hook coupling holes 713*c* formed at the supporter body 713*a* such that the hook coupling holes 713*c* correspond to the hooks, respectively.

The supporter body 713*a* has a recessed step on which the gasket holder 712 and gasket 711 are seated. A communicating hole 713*b* having a predetermined diameter is formed through the support body 713*a* inside the step. The communicating hole 713*b* communicates with the cold air hole 711*b* of the gasket 711. The hooks extend through the hook coupling holes 713*c*, respectively, and engage with the rear surface of the supporter body 713*a*.

*In detail, hook engaging grooves 713*d* are fanned at the rear surface of the supporter body 713*a*. The hook engaging grooves 713*d* receive respective ends of the hooks. A support protrusion 712*c* is formed at each hook. The support protrusion 712*c* supports the edge of the associated hook engaging groove 713*d* at one side of the associated hook engaging groove 713*d*. Each hook is preferably made of an elastic material.

Accordingly, when each hook 712*b* is engaged with the rear surface of the supporter body 713*a* after extending through the associated hook coupling hole 713*c*, a portion of the holder coupler 711*d* is fitted between the holder body 712*a* and the supporter body 713*a*. Thus, the gasket 711 is fixed to the gasket supporter 713.

It is preferred that the gasket 711 having the above-described structure be made of a flexible material. For example, the gasket 711 may be made of a material having elasticity, such as rubber.

The gasket supporter 713 is fixed to the left door 210. In detail, the gasket supporter 713 is fixed to the second opening 501 of the inner case 530, thereby supporting the gasket holder 420 such that the gasket holder 420 is fixedly maintained.

Of course, the sealing units 710 and 720, which have the above-described configuration, may also be provided at the first opening 601.

Where the first opening 601 includes the duct-side air supply port 601*a* and duct-side inlet 601*b*, and the second opening 501 includes the door-side inlet 501*a* and door-side outlet 501*b*, the sealing units 710 and 720 are provided at least one of the duct-side air supply port 601*a*, duct-side inlet 601*b*, door-side inlet 501*a*, and door-side outlet 501*b*.

In this case, it is preferred that the sealing units 710 and 720 be provided at least one of the duct-side air supply port 601*a* and door-side inlet 501*a* and at least one of the duct-side inlet 601*b* and door-side outlet 501*b*. Of course, the sealing units 710 and 720 may be provided at each of the duct-side air supply port 601*a*, duct-side inlet 601*b*, door-side inlet 501*a*, and door-side outlet 501*b*.

Meanwhile, in this embodiment, cold air generated by the heat exchanger 310 is introduced into the air supply duct 610 of the duct unit after passing through the interior of the barrier 210. Where the duct unit 600 includes the return duct 620, cold air discharged out of the ice making compartment 500 is introduced into the freezing compartment 300 after passing through the interior of the barrier 210.

A grill pan 340 is arranged at the rear side of the freezing compartment 300, to form the rear wall of the freezing compartment 300. The grill pan 340 has a fan mounting portion 341 to which a cold air supply fan (not shown) is mounted.

Although not shown, constituent elements of the refrigerant cycle such as a compressor and the heat exchanger 310 are installed at the rear side of the grill fan 340.

Other configurations of the refrigerator according to the second embodiment of the present invention are identical to those of the first embodiment it the present invention. Accordingly, no repeated description will be given of the identical configurations.

Hereinafter, a refrigerator according to a third embodiment of the present invention will be described with reference to FIGS. 10 and 11.

Figure 10:
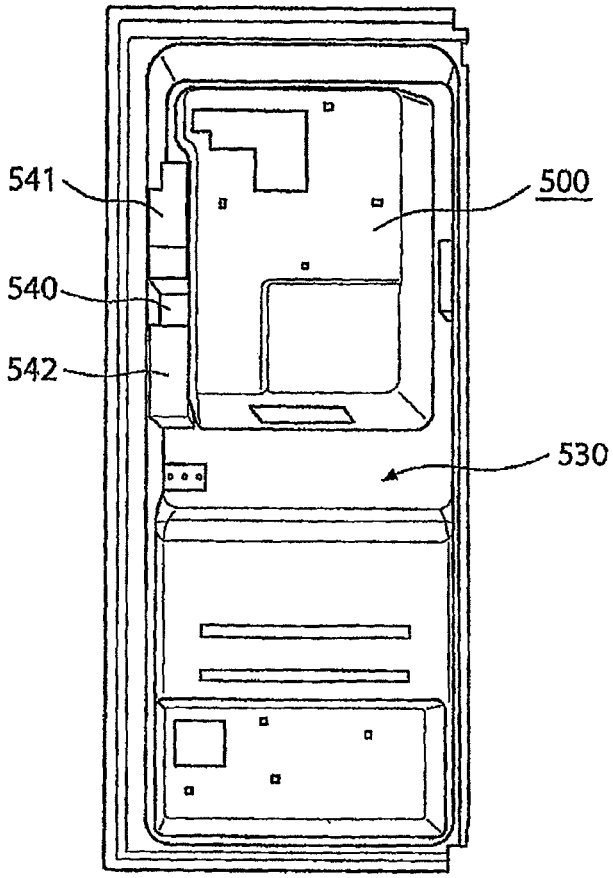
FIG. 10 is a front view illustrating an inner case included in a refrigerator door which is applied to a refrigerator according to a third embodiment of the present invention.

FIG. 10 is a front view illustrating an inner case included in a refrigerator door which is applied to the refrigerator according to the third embodiment of the present invention. FIG. 11 is an exploded perspective view illustrating a door duct unit provided at the inner case shown in FIG. 10, and a sealing unit provided at the door duct unit.

The basic constituent elements of the refrigerator according to the third embodiment of the present invention are identical to those of the refrigerator according to the first embodiment and/or second embodiment of the present invention. In the following description given in conjunction with the refrigerator according to the third embodiment of the present invention, the constituent elements identical to those of the first embodiment and/or second embodiment of the present invention will be designated by the same reference numerals as those used in the first embodiment and/or second embodiment of the present invention, respectively, and no additional description thereof will be given.

Figure 11:
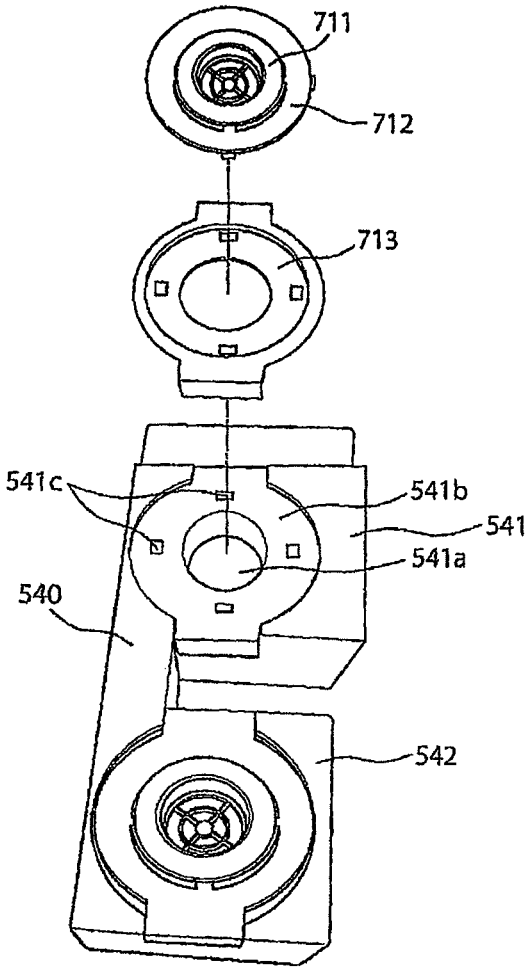
FIG. 11 is an exploded perspective view illustrating a door duct unit provided at the inner case shown in FIG. 10, and a sealing unit provided at the door duct unit.

In accordance with the third embodiment of the present invention, the ice making compartment 500 includes a door duct 540 which connects the interior of the ice making compartment 500 to the duct unit 600, as shown in FIGS. 10 and 11.

The door duct 540 is provided at the refrigerating compartment door unit 400, in particular, in the interior of the inner case 530 of the left door 410.

Referring to FIG. 10, the top wall of the inner case 530 is rearwardly recessed to form the ice making chamber 510. The door duct 540 may be arranged inside the second opening 501 such that the door duct 540 communicates with the second opening 501. Alternatively, the door duct 540 may be exposed externally of the inner case 530 at one side of the door duct 540 such that the door duct 540 firms the second opening 501.

The door duct 540 is received in a space defined between the second opening 501 and the ice making chamber 510, in a fixed state.

The door duct 540 has a first duct portion 541 which communicates with the air supply duct 610, and a second duct portion 542 which communicates with the return duct 620.

In this embodiment, the inlet of the first duct portion 541 and the outlet of the second duct portion 542 form the door-side inlet 501*a* and door-side outlet 501*b*, respectively. It is preferred that the above-described sealing unit 710 be provided at each of the inlet of the first duct portion 541 and the outlet of the second duct portion 542.

Hereinafter, the door duct 540 will be described in more detail. The first duct portion 541 includes a body 541*b* centrally formed with a through hole 541*a*.

It is preferred that the through hole 541*a* have an inlet which forms the door-side inlet 501*a*. It is also preferred that the body 541*b* have a step recessed to a predetermined depth to receive the sealing unit 710.

Preferably, the step has an edge having the same shape as the appearance of the gasket supporter 713 and has a depth approximately identical to the thickness if the gasket supporter 713 in order to prevent the sealing unit 701 from juggling after being fitted in the step.

A plurality of supporter mounting grooves 541*c* are formed at the step, in order to fix the gasket supporter 713 to the step of the first duct portion 541. Also, the above-described coupling protrusions (not shown) are formed at the gasket supporter 713. The coupling protrusions are engaged in the supporter mounting grooves 541*c*, respectively.

The second duct portion 542 may have the same structure as that of the first duct portion 541.

Meanwhile, the door duct 540 is made or an insulating material in order to minimize thermal loss of cold air because the door duct 540 guides cold air introduced into or discharged out of the duct unit 600. Preferably, the door duct 540 is made of an insulating material such as expanded polystyrene (EPS) which is easily moldable, and has superior insulation properties.

Thus, cold air supplied from the heat exchanger 310 is introduced into the ice making chamber 510 via the air supply duct 610 and first duct portion 541 of the door duct 540. On the other hand, cold air discharged out of the ice making chamber 510 is returned to the freezing compartment 300 via the second duct portion 542 of the door duct 540 and return duct 620.

Other configurations of the refrigerator according to the third embodiment of the present invention are identical to those of the first embodiment and/or second embodiment of the present invention. Accordingly, no repeated description will be given of the identical configurations.

Hereinafter, a refrigerator according to a fourth embodiment of the present invention will be described with reference to FIGS. 12 and 16.

Figure 12:
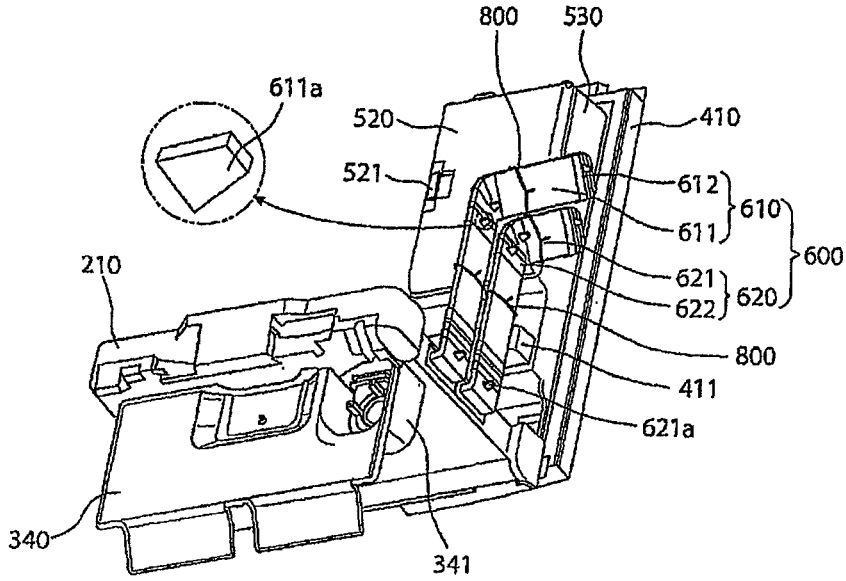
FIG. 12 is a perspective view illustrating a cold air guide device and a refrigerator door which are applied to a refrigerator according to a fourth embodiment of the present invention.
Figure 13:
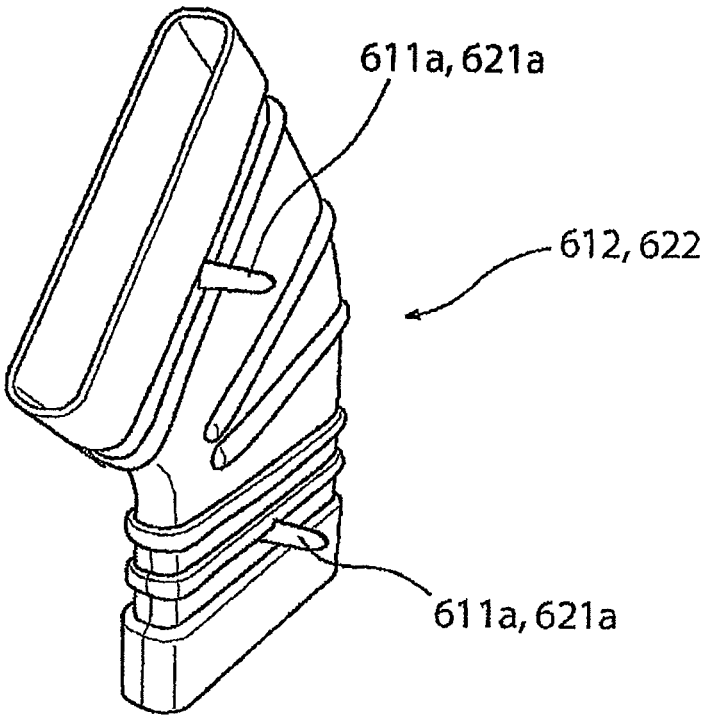
FIG. 13 is a perspective view illustrating a part of a duct constituting the cold air guide device shown in FIG. 12.
Figure 14:
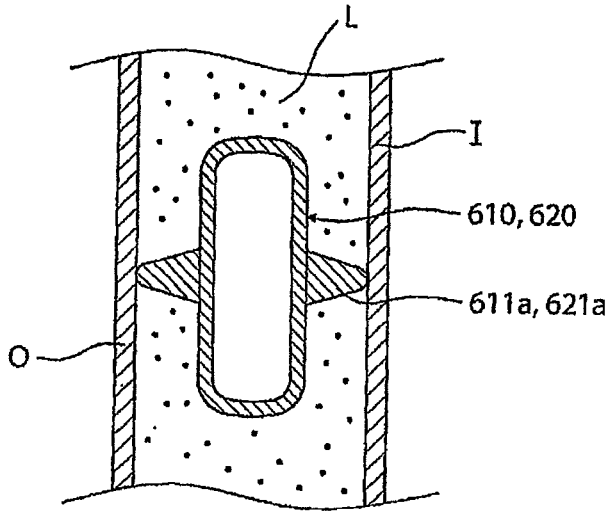
FIG. 14 is a sectional view illustrating a state in which the duct shown in FIG. 13 is installed at one wall of the refrigerator.
Figure 15:
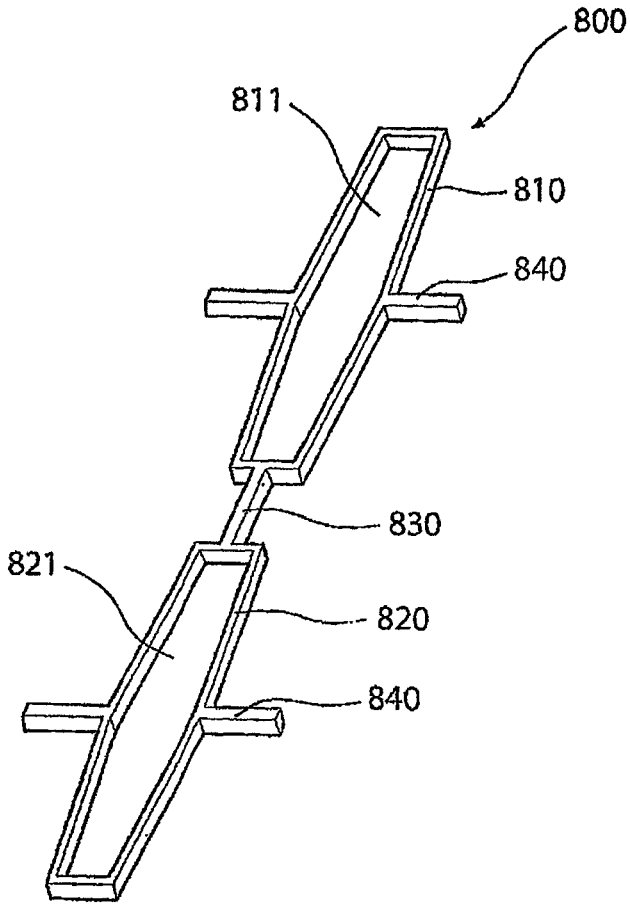
FIG. 15 is a perspective view illustrating a duct holder applied to the refrigerator according to the fourth embodiment of the present invention.

FIG. 12 is a perspective view illustrating a cold air guide device and a refrigerator door which are applied to the refrigerator according to the fourth embodiment of the present invention. FIG. 13 is a perspective view illustrating a part of a duct constituting the cold air guide device shown in FIG. 12. FIG. 14 is a sectional view illustrating a state in which the duct shown in FIG. 13 is installed at one wall of the refrigerator. FIG. 15 is a perspective view illustrating a duct holder applied to the refrigerator according to the fourth embodiment of the present invention. FIG. 16 is a sectional view illustrating a state in which the duct is installed at one wall of the refrigerator by the duct holder shown in FIG. 15.

The basic constituent elements of the refrigerator according to the fourth embodiment of the present invention are identical to those of the refrigerator according to at least one of the first through third embodiments of the present invention. In the following description given in conjunction with the refrigerator according to the fourth embodiment of the present invention, the constituent elements identical to those of at least one of the first through third embodiments of the present invention will be designated by the same reference numerals as those used in at least one of the first through third embodiments of the present invention, respectively, and no additional description thereof will be given.

Referring to FIGS. 12 to 14, the refrigerator according to the fourth embodiment of the present invention includes a spacer which spaces ducts internally arranged at one side wall of the refrigerator from the outer wall O and inner wall I forming the side wall of the refrigerator.

Here, the ducts include the above-described air supply duct 610 and return duct 620.

The spacer supports the air supply duct 610 and/or return duct 620 to be spaced apart from the outer wall O and inner wall I.

The spacer is provided to minimize thermal loss of cold air flowing through the duct unit 600 and to easily fill a foaming liquid between the outer wall O and the inner wall I.

It is preferred that the spacer be configured to uniformly space each of the ducts 610 and 620 from the outer wall O and inner wall I.

The spacer includes at least one spacing rib protruded from the outer surface of an associated one of the ducts 610 and 620.

The spacing rib functions to arrange the associated duct, namely, the air supply duct 610 or return duct 629, at a desired correct position in one side wall of the refrigerating compartment 200.

In this embodiment, the spacer includes two spacing ribs 611*a* or 621*a* which are protruded from the outer surface of the associated air supply duct 610 or return duct 620 in a symmetrical manner. Of course, it is preferred that spacing ribs 611*a* and spacing ribs 621*a* are provided at the air supply duct 610 and return duct 620, respectively.

The spacing ribs 611*a* or 621*a* extend in opposite directions from the outer surface of the associated duct 610 or 620, respectively.

Thus, the air supply duct 610 and/or return duct 620 is centrally arranged between the outer wall O and the inner wall I.

The spacing ribs 611*a* and 621*a* preferably have a shape having a small cross-sectional area, in order to minimize the area of the spacing ribs 611*a* and 621*a* contacting the outer wall O and inner wall I. Accordingly, it is possible to minimize thermal loss caused by the spacing ribs.

When the ducts 610 and 620 are centrally arranged between the inner wall I and the outer wall O, the foaming liquid L filling the space between the outer wall O and inner wall I can smoothly flow. In other words, since the distance between each of the ducts 610 and 620 and the inner wall I, and the distance between each of the ducts 610 and 620 and the outer wall O are uniform, the foaming liquid L can sufficiently fill the space between the inner wall I and the outer wall O.

Meanwhile, the air supply duct 610 includes at least one main duct 611 which guides cold air to flow rectilinearly, and a connecting duct 612 which varies the flow direction of cold air flowing through the air supply duct 610. The connecting duct 612 may be connected to one end of the main duct 611. Where the air supply duct 610 includes, for example, two main ducts 611, the connecting duct 612 may be connected between the facing ends of the main ducks 611.

Where the duct unit 601 includes, in addition to the air supply duct 610, the return duct 620, the return duct 620 includes, similarly to the air supply duct 610, at least one main duct 621 which guides cold air to flow rectilinearly, and a connecting duct 622 which varies the flow direction of cold air flowing through the return duct 620. The connecting duct 622 may be connected to one end of the main duct 621. Where the return duct 620 includes, for example, two main ducts 621, the connecting duct 622 may be connected between the facing ends of the main ducts 621.

Each of the main ducts 611 and 621 has an approximately rectilinear shape. Each of the connecting ducts 612 and 622 has a curved shape to guide a flow of cold air. The connecting duct 612 or 622 may form one end of the associated air supply duct 610 or return duct 620. Where the connecting duct 612 or 622 is connected between the adjacent main ducts 611 or 621, it varies the flow direction of cold air.

In this embodiment, the spacing ribs 611*a* and 621*a* are provided at the outer surfaces of the associated connecting ducts 612 and 622, respectively. However, the present invention is not limited to this arrangement. The spacing ribs 611*a* and 621*a* may be provided at the outer surfaces of the associated main ducts 611 and 621, respectively.

The refrigerator according to the fourth embodiment of the present invention may further include a duct holder 800 which functions to fix the ducts 610 and 620 to one side wall of the refrigerating compartment 200.

In detail, at least one of the air supply duct 610 and return duct 620 is coupled to the duct holder 800, and is fixed to one side wall of the refrigerating compartment 200 by the duct holder 800.

Figure 16:
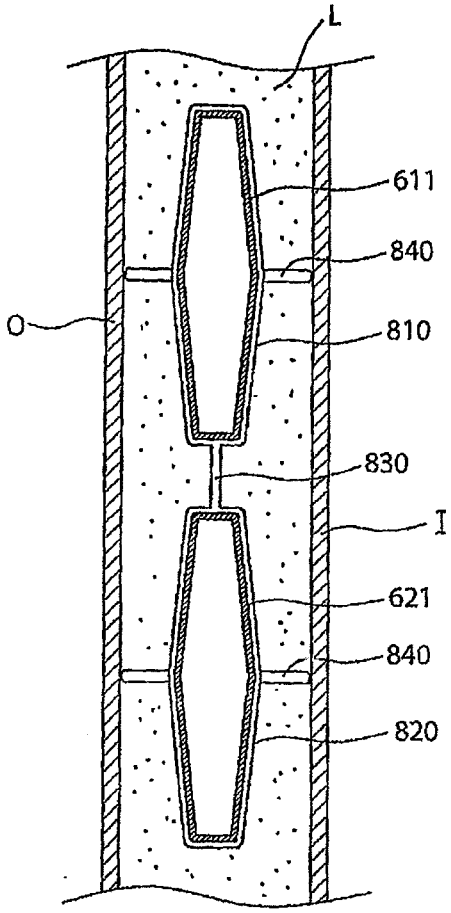
FIG. 16 is a sectional view illustrating a state in which the duct is installed at one wall of the refrigerator by the duct holder shown in FIG. 15.

Referring to FIG. 13, and FIGS. 15 and 16, the duct holder 800 includes duct receivers 810 and 820 which receive the ducts 610 and 620 in a fixed state, respectively.

In this embodiment, the duct holder 800 simultaneously fixes the air supply duct 610 and return duct 620. To this end, it is preferred that the duct holder 800 include a pair of duct receivers, namely, duct receivers 810 and 820, which are connected to each other such that they are integral.

Hereinafter, the duct receiver 810, which receives the air supply duct 610, is also referred to as a first duct receiver, whereas the duct receiver 820, which receives the return duct 620, is also referred to as a second duct receiver.

The duct receivers 810 and 820 have duct receiving holes 811 and 812 through which the ducts 610 and 620 extend, respectively. The duct receivers 810 and 820 are connected to each other by a connecting rib 830.

The shapes of the duct receiving holes 811 and 821 correspond to the outer cross-sectional shapes of the air supply duct 610 and return duct 620, respectively. Accordingly, the air supply duct 610 and return duct 620 are fixed as they are fitted in the duct receiving hole 811 of the first duct receiver 810 and the duct receiving hole 821 of the second duct receiver 820, respectively.

In addition to the above-described configuration, the duct holder 800 preferably includes at least one spacing protrusion 840 outwardly protruded from the outer surface of each of the duct receivers 810 and 820.

The spacing protrusion 840 has the same function as those of the above-described spacing ribs 611*a* and 621*a*. Accordingly, the duct unit 600 may include the spacing protrusions 840 or the spacing ribs 611*a* and 621*a* alone.

Of course, there is a difference between the spacing protrusions 840 and the spacing ribs 611*a* and 621*a* in that the spacing protrusions 840 are protruded from respective outer surfaces of the duct receivers 810 and 820, whereas the spacing ribs 611*a* and 621*a* are protruded from respective outer surfaces of the ducts 610 and 620.

The spacing protrusions 840 formed at each of the duct receivers 810 and 820 are arranged at opposite sides of the associated duct receiver 810 or 820. Accordingly, the spacing protrusions 840 maintain the air supply duct 610 and return duct 620 at a central position between the outer wall O and the inner wall I.

Where the air supply duct 610 and return duct 620 are centrally arranged between the inner wall I and the outer wall O, the foaming liquid L filling the space between the inner wall I and the outer wall O can smoothly flow. Accordingly, the foaming liquid L can sufficiently fill the space between the inner wall I and the outer wall O.

Other configurations of the refrigerator according to the fourth embodiment of the present invention are identical to those of the first through third embodiment of the present invention. Accordingly, no repeated description will be given of the identical configurations.

Hereinafter, a refrigerator according to a fifth embodiment of the present invention will be described with reference to FIG. 17.

Figure 17:
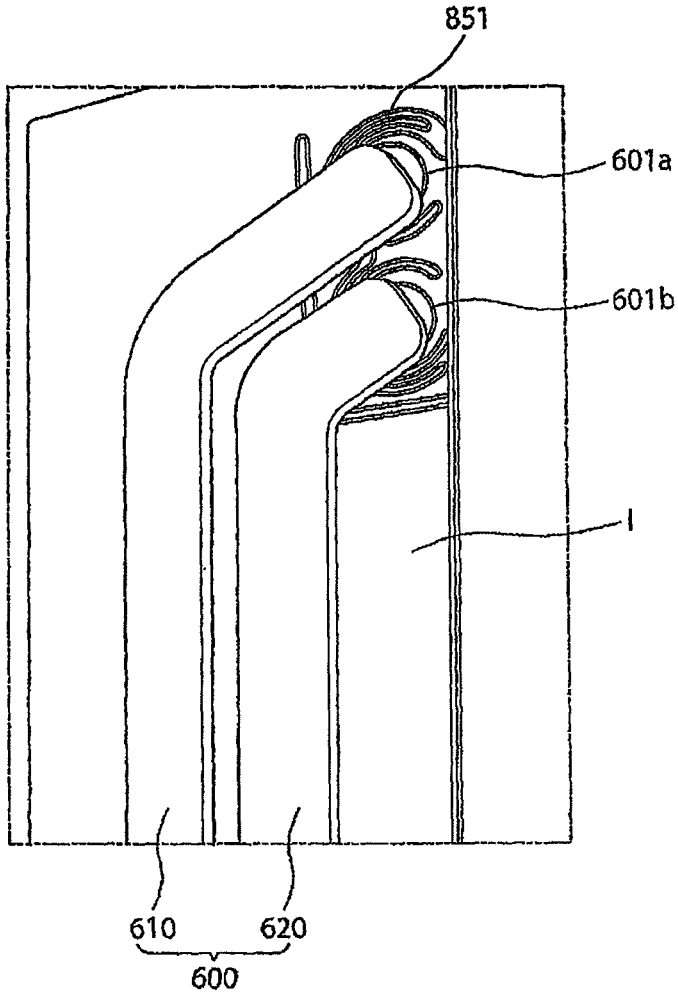
FIG. 17 is a perspective view illustrating a first heater which is applied to a refrigerator according to a fifth embodiment of the present invention, and is installed in a refrigerating compartment wall.

FIG. 17 is a perspective view illustrating a first heater which is applied to the refrigerator according to the fifth embodiment of the present invention, and is installed in a refrigerating compartment wall.

The basic constituent elements of the refrigerator according to the fifth embodiment of the present invention are identical to those of the refrigerator according to at least one of the first through fourth embodiments of the present invention. In the following description given in conjunction with the refrigerator according to the fifth embodiment of the present invention, the constituent elements identical to those of at least one of the first through fourth embodiments of the present invention will be designated by the same reference numerals as those used in at least one of the first through fourth embodiments of the present invention, respectively, and no additional description thereof will be given.

Referring to FIG. 17, the refrigerator according to the fifth embodiment of the present invention includes a first heater 851 which prevents a frosting phenomenon from occurring in the refrigerating compartment 200 due to cold air flowing through the ducts 610 and 620.

In this case, at least one of the ducts 610 and 620, namely, the air supply duct 610 and return duct 620, is arranged in one side wall of the refrigerating compartment 200. The first heater 851 is arranged on one side wall of the refrigerating compartment 200.

In detail, the ducts 610 and 620 are arranged between the outer wall O and inner wall I of the refrigerating compartment 200. The first heater 851 is arranged on the inner wall I of the refrigerating compartment 200. In other words, the first heater 851 is installed on the inner wall of the refrigerating compartment 200, to increase the temperature of the inner wall I of the refrigerating compartment 200. In particular, the first heater 851 is preferably arranged on one surface of the inner wall I of the refrigerating compartment 200 contacting the filled foaming liquid L such that the first beater 851 is not outwardly exposed.

More preferably, the first heater 851 is arranged adjacent to the first opening 601.

Cold air is introduced into the duct unit 600 through the duct-side air supply port 601*a*, and is discharged out of the duct unit 600 through the duct-side inlet 601*b*. If there is no heater arranged near the duct-side air supply port 601*a* and duct-side inlet 601*b*, such as the first heater 851, a decrease in temperature occurs around the duct-side air supply port 601*a* and duct-side inlet 601*b* due to the influence of the cold air flowing through the duct unit 600. For this reason, it is preferred that the first heater 851 be arranged adjacent to the first opening 601.

The first heater 851 heats the inner wall of the refrigerating compartment 200 such that the temperature of the inner wall of the refrigerating compartment 200 is similar to the internal temperature of the refrigerating compartment 200.

In detail, it is preferred that the first heater 851 be arranged around each of the duct-side air supply port 601*a* and duct-side inlet 601*b*. The first heater 851 includes a heating wire having a plurality of bent portions. The heating wire generates heat when external electric power is applied to the wire.

Although not shown, the refrigerator may further include a temperature sensor which measures the wall temperature of the refrigerating compartment 200, and a power controller which selectively turns on or of the heater 130, based on the value measured by the temperature sensor.

Using the first heater 851 having the above-described configuration, it is possible to prevent a frosting phenomenon from occurring at the inner surface of the refrigerating compartment 200 due to the cold air flowing through the duct-side air supply port 601*a* and duct-side inlet 601*b*.

Other configurations of the refrigerator according to the fifth embodiment of the present invention are identical to those of the first through fourth embodiments of the present invention. Accordingly, no repeated description will be given of the identical configurations.

Hereinafter, a refrigerator according to a sixth embodiment of the present invention will be described with reference to FIGS. 18 to 21.

The basic constituent elements of the refrigerator according to the sixth embodiment of the present invention are identical to those of the refrigerator according to at least one of the first through fifth embodiments of the present invention. In the following description given in conjunction with the refrigerator according to the sixth embodiment of the present invention, the constituent elements identical to those of at least one of the first through fifth embodiments of the present invention will be designated by the same reference numerals as those used in at least one of the first through fifth embodiments of the present invention, respectively, and no additional description thereof will be given.

Figure 18:
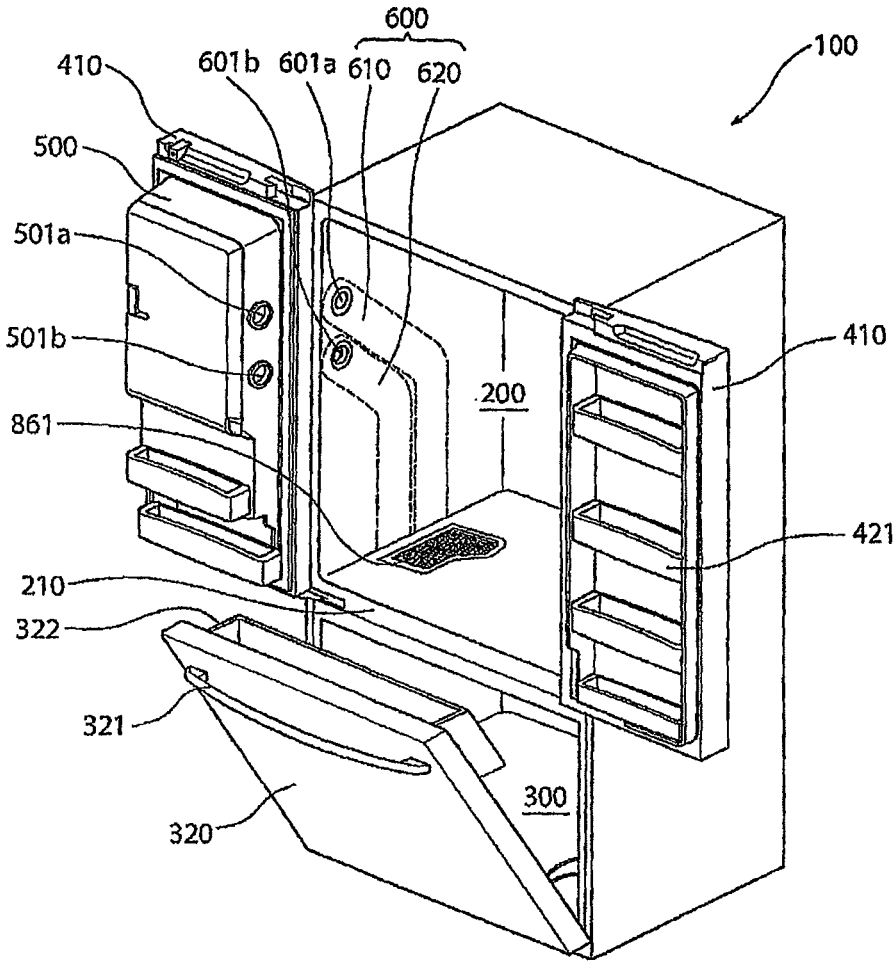
FIG. 18 is a perspective view of a refrigerator according to a sixth embodiment of the present invention, illustrating opened states of the refrigerating compartment doors and freezing compartment door.
Figure 19:
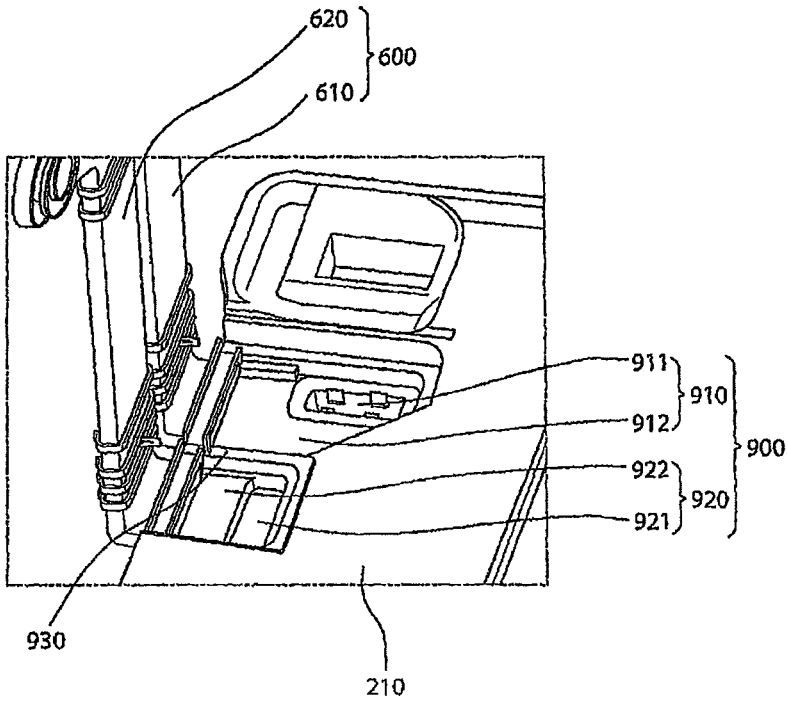
FIG. 19 is a perspective view illustrating a cold air guide arranged at the barrier of the refrigerator shown in FIG. 18.
Figure 20:
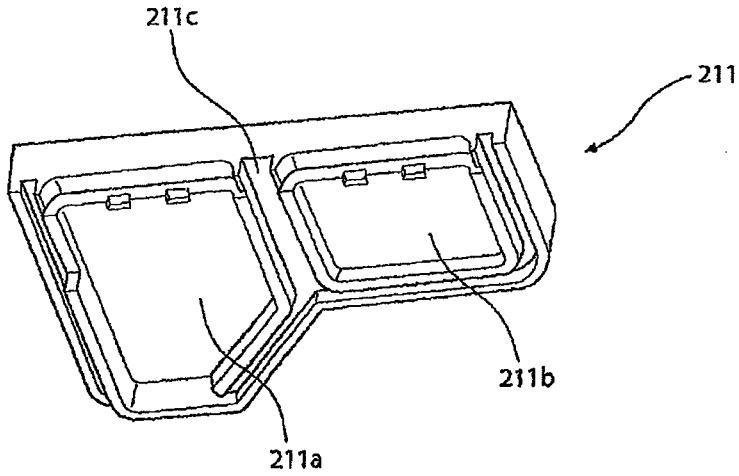
FIG. 20 is a perspective view illustrating a barrier cover which opens or closes the cold air guide shown in FIG. 19.
Figure 21:
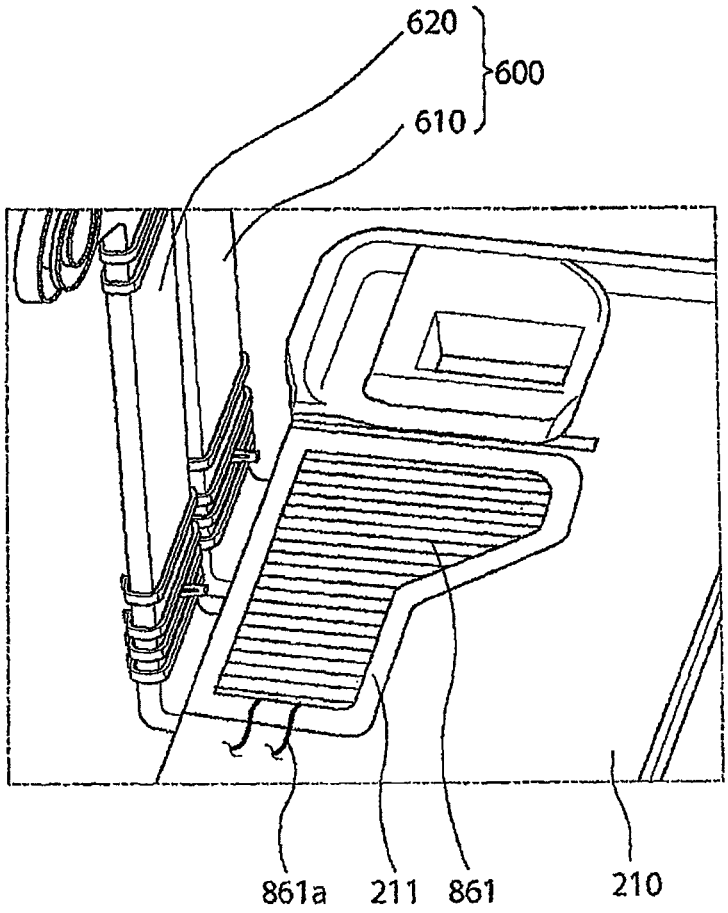
FIG. 21 is a perspective view illustrating a state in which the cold air guide is closed by the barrier cover shown in FIG. 20.

FIG. 18 is a perspective view of the refrigerator according to the sixth embodiment of the present invention, illustrating opened states of the refrigerating compartment doors and freezing compartment door. FIG. 19 is a perspective view illustrating a cold air guide arranged at the barrier of the refrigerator shown in FIG. 18. FIG. 20 is a perspective view illustrating a barrier cover which opens or closes the cold air guide shown in FIG. 19. FIG. 21 is a perspective view illustrating a state in which the cold air guide is closed by the barrier cover shown in FIG. 20.

*Referring to FIGS. 18 to 21, the refrigerator according to the sixth embodiment of the present invention includes cold air guide 900 which is arranged in the barrier 210 partitioning the refrigerating compartment 200 and freezing compartment 300.

The cold air guide 900 is configured to connect the duct unit 600 and freezing compartment 300.

In detail, the cold air guide 900 includes an air supply passage 910 which guides cold air generated by the heat exchanger 310 to the air supply duct 610.

Where the duct unit 600 further includes the return duct 620, as described above, the cold air guide 900 further includes a return passage 920.

In this case, it is preferred that a partition wall 930 be arranged between the air supply passage 910 and the return passage 920.

The return passage 920 guides cold air, which is guided through the duct unit, in particular, the return duct 620, after emerging from the ice making compartment 500, to the freezing compartment 300.

In detail, the air supply passage 910 includes an air supply hole 911 which extends vertically, and an air supply guide 912 which guides cold air from the air supply hole 911 to the air supply duct 610.

The return passage 920 includes a return hole 921 which extends vertically, and a return guide 922 which guides cold air from the return duct 620 to the return hole 921.

In addition to the above-described configuration, the barrier 210 includes a cover 211 which opens or closes the cold air guide 900.

The cover 211 is separably coupled to the cold air guide 900. The cover 211 includes an air supply cover 211*a* for opening or closing the air supply passage 910, and a return cover 211*b* for opening or closing the return passage 920. Preferably, the air supply cover 211*a* and return cover 211*b* are integrally formed.

The cover 211 also includes a partition groove 211*c* formed between the air supply cover 211*a* and the return cover 211*b*, to provide a sealing effect between the air supply passage 910 and the return passage 920.

The cover 211 having the above-described configuration is detachably attached to the top of the cold air guide 900.

Where cold air flowing through the duct unit 600 passes through the interior of the bather 210, as described above, it is preferred that a second heater 861 be provided at the barrier 210, in order to prevent a frosting phenomenon from occurring in the interior of the refrigerating compartment 200.

Preferably, the second heater 861 is arranged at one surface of the bather 210 facing the interior of the refrigerating compartment 200, namely, the top surface of the bather 210. That is, the second heater 861 is arranged at the bottom of the refrigerating compartment 200. Electric wires 861*a* are connected to the second heater 861, to supply electric power to the second heater 861.

Where the bather 210 includes the cover 211 for opening or closing the cold air guide 900, as in this embodiment, it is more preferable for the second heater 861 to be arranged at the top surface of the cover 211.

Meanwhile, the second heater 861 is configured to operate selectively in accordance with a predetermined condition.

In detail, the second heater 861 is automatically turned on or off in accordance with the temperature at the bottom of the refrigerating compartment 200. That is, when the temperature value measured by a temperature sensor (not shown), which measures the temperature at the bottom of the refrigerating compartment 200, is lower than a predetermined lower limit, the second heater 861 is turned on by a power supply controller (not shown). On the other hand, when the temperature value measured by the temperature sensor is higher than a predetermined upper limit, the second heater 861 is turned off by the power supply controller.

Other configurations of the refrigerator according to the sixth embodiment of the present invention are identical to those of the first through fifth embodiments of the present invention. Accordingly, no repeated description will be given of the identical configurations.

Finally, a refrigerator according to a seventh embodiment of the present invention will be described with reference to FIG. 22.

The basic constituent elements of the refrigerator according to the seventh embodiment of the present invention are identical to those of the refrigerator according to at least one of the first through sixth embodiments of the present invention. In the following description given in conjunction with the refrigerator according to the seventh embodiment of the present invention, the constituent elements identical to those of at least one of the first through sixth embodiments of the present invention will be designated by the same reference numerals as those used in at least one of the first through sixth embodiments of the present invention, respectively, and no additional description thereof will be given.

Figure 22:
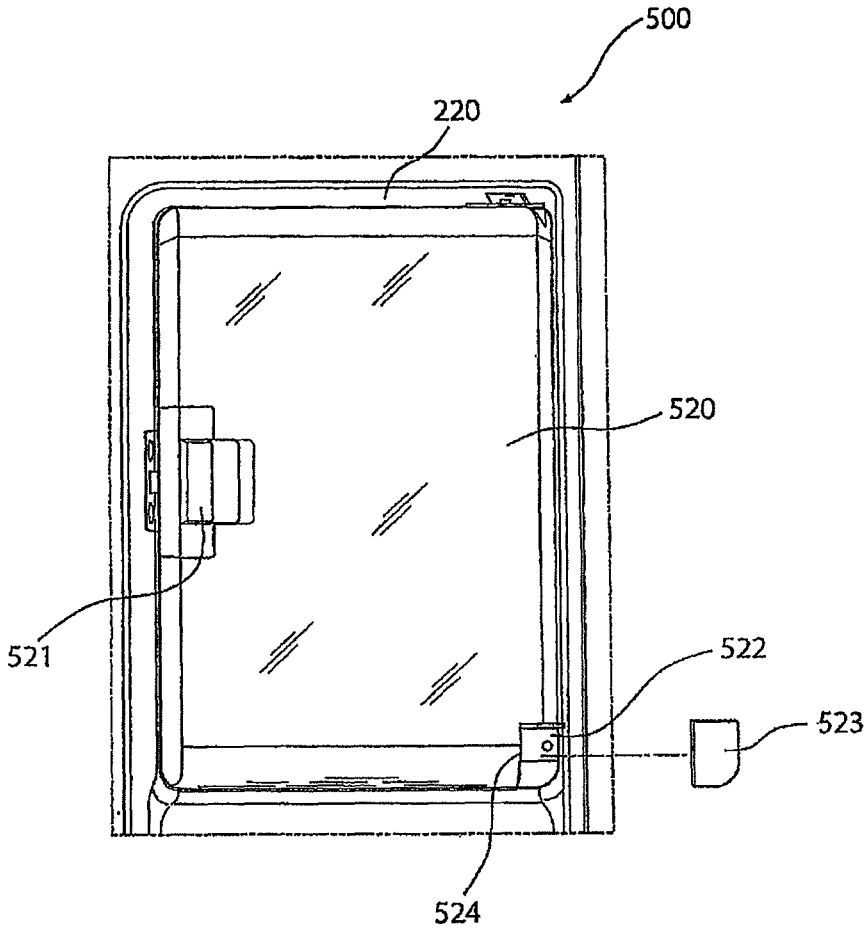
FIG. 22 is a perspective view of an ice making compartment applied to a refrigerator according to a seventh embodiment of the present invention, taken at the rear side.

FIG. 22 is a perspective view of an ice making compartment applied to the refrigerator according to the seventh embodiment of the present invention, taken at the rear side.

Referring to FIG. 22, the ice making compartment door 520 in the refrigerator according to the seventh embodiment of the present invention is hingably connected to one side of the opening of the freezing compartment 510 by hinges 522.

Thus, the ice making compartment door 520 is hingably openable about the hinges 522.

It is preferred that the hinges 522 be arranged on upper and lower corners of the ice making compartment door 520 at one edge of the ice making compartment door 520.

The refrigerator according to the seventh embodiment of the present invention further includes a hinge cover 523 which covers each hinge 522.

To mount the hinge cover 523, a cover mount 524 is provided at the associated corner of the ice making compartment door 520. The hinge cover 523 has a size and shape corresponding to those of the associated cover mount 524.

Accordingly, when the hinge cover 523 is mounted to the associated cover mount 524, the associated hinge 522 is not outwardly exposed.

The hinge cover 523 prevents an accident in that a portion of the body of the user is caught in the hinge 522 through his carelessness, and makes the appearance of the ice making compartment beautiful.

Other configurations of the refrigerator according to the seventh embodiment of the present invention are identical to those of the first through sixth embodiments of the present invention. Accordingly, no repeated description will be given of the identical configurations.

It will be apparent to those skilled in the art that various modifications and variations can be made in the present invention without departing from the spirit or scope of the invention.

Thus, it is intended that the present invention cover the modifications and variations of this invention provided they come within the scope of the appended claims and their equivalents.

Industrial Applicability

The refrigerator having the above-described configuration has various advantages.

The industrial applicability of the refrigerator according to the present invention has been described in "Best Mode" and "Mode for Invention".

Since the refrigerator according to the present invention typically includes a cold air gliding device for guiding cold air generated by a heat exchanger to an ice making compartment arranged in a refrigerating compartment, it is possible to appropriately select the position of the ice making compartment irrespective of the structure or capacity of the refrigerator. Accordingly, it is possible to achieve an improvement in the freedom of design of the refrigerator, and a reduction in the manufacturing costs of the refrigerator, and to maximize the inner space of the refrigerating compartment. Such advantages become more effective where a freezing compartment is arranged beneath the refrigerating compartment.

What is claimed is:

1. A refrigerator, comprising:

a freezing compartment for storing items in a frozen state;

a refrigerating compartment disposed adjacent to the freezing compartment and storing items in a refrigerated state;

an additional compartment for storing ice, the additional compartment disposed at a side of the refrigerating compartment;

a duct provided within a wall defining the refrigerating compartment, the duct extending to the additional compartment along the wall of the refrigerating compartment;

a barrier partitioning the freezing compartment and the refrigerating compartment; and a cold air guide arranged within the barrier, wherein the cold air guide includes a return passage to return the air within the additional compartment to the freezing compartment.

2. The refrigerator according to claim 1, wherein the cold air guide communicates with an end of the duct.

3. The refrigerator according to claim 1, wherein the cold air guide fluidly connects the duct and the freezing compartment.

4. The refrigerator according to claim 1, wherein the return passage includes:

a return hole which communicates with the freezing compartment; and a return guide which connects an end of the duct and the return hole.

5. A refrigerator, comprising:

a freezing compartment for storing items in a frozen state;

a refrigerating compartment disposed adjacent to the freezing compartment for storing items in a refrigerated state;

an additional compartment for storing ice, the additional compartment disposed at a side of the refrigerating compartment;

a duct provided within a wall defining the refrigerating compartment, the duct extending to the additional compartment along the wall of the refrigerating compartment;

a barrier partitioning the freezing compartment and the refrigerating compartment;

a cold air guide arranged within the barrier;

a heat exchanger generating cold air; and an air supply duct allowing the cold air generated by the heat exchanger to flow into the additional compartment.

6. The refrigerator according to claim 5, wherein the cold air guide includes an air supply passage to fluidly connect the air supply duct and a space in which the heat exchanger is received.

7. The refrigerator according to claim 6, wherein the air supply passage includes:

an air supply hole in which the cold air generated by the heat exchanger is introduced; and an air supply guide which fluidly connects an end of the air supply duct and the air supply hole.

8. A refrigerator, comprising:

a freezing compartment for storing items in a frozen state;

a refrigerating compartment disposed adjacent to the freezing compartment for storing items in a refrigerated state;

an additional compartment for storing ice, the additional compartment disposed at a side of the refrigerating compartment;

a duct provided within a wall defining the refrigerating compartment, the duct extending to the additional compartment along the wall of the refrigerating compartment;

a barrier partitioning the freezing compartment and the refrigerating compartment;

a cold air guide arranged within the barrier; and a heater within the barrier.

9. The refrigerator according to claim 8, further comprising a sensor for detecting temperature of the refrigerating compartment, wherein the heater is selectively turned on and off based on the value detected by the sensor.

10. The refrigerator according to claim 9, wherein the temperature detected by the sensor is the temperature of a surface defining the refrigerating compartment.

11. The refrigerator according to claim 10, wherein the surface defining the refrigerating compartment includes an upper surface of the barrier, the upper surface of the barrier exposed to the air within the refrigerating compartment.

* * * * *